US007861654B2

(12) United States Patent
Koblinger

(10) Patent No.: US 7,861,654 B2
(45) Date of Patent: Jan. 4, 2011

(54) CYLINDER WITH RETAINING DEVICE AND A CONTROL ASSEMBLY FOR CONTROLLING THE FORCE EXERTED ON THE RETAINING DEVICE

(75) Inventor: Michael Koblinger, Zellingen (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 12/734,847

(22) PCT Filed: Oct. 10, 2008

(86) PCT No.: PCT/EP2008/063613

§ 371 (c)(1),
(2), (4) Date: May 27, 2010

(87) PCT Pub. No.: WO2009/068359

PCT Pub. Date: Jun. 4, 2009

(65) Prior Publication Data

US 2010/0263562 A1 Oct. 21, 2010

(30) Foreign Application Priority Data

Nov. 29, 2007 (DE) ..... 10 2007 047 892

(51) Int. Cl.
*B41F 27/12* (2006.01)

(52) U.S. Cl. ..... 101/415.1; 101/378

(58) Field of Classification Search ..... 101/415.1, 101/378, 375

See application file for complete search history.

(56) References Cited

U.S. PATENT DOCUMENTS

| | | | | |
|---|---|---|---|---|
| 3,058,417 | A * | 10/1962 | Norlin | 101/415.1 |
| 5,503,072 | A * | 4/1996 | Schneider | 101/415.1 |
| 7,234,397 | B2 | 6/2007 | Schafer | |
| 2003/0159604 | A1 | 8/2003 | Schneider et al. | |

FOREIGN PATENT DOCUMENTS

| | | | |
|---|---|---|---|
| DE | 102 44 574 | A1 | 4/2004 |
| WO | WO 03/091024 | A1 | 11/2003 |
| WO | WO 2004/002742 | A1 | 1/2004 |

* cited by examiner

*Primary Examiner*—Leslie J Evanisko
(74) *Attorney, Agent, or Firm*—Jones, Tullar & Cooper, P.C.

(57) ABSTRACT

A cylinder of a printing machine is provided with at least one axially extending channel located beneath the circumferential surface of the cylinder. At least one plate end holding device is arranged in the channel and usable to exert a clamping force on an end of at least one printing forme or plate positioned on the assembly's circumferential surface. At least one control assembly is utilized to counteract the clamping force exerted on the plate end by the at least one holding device. A force that is exerted by the control assembly can be set to a value which is different either a maximum force or a minimum force which the control assembly can exert. Preferably, the circumferential surface of the cylinder can be divided, in its axial direction, into several adjacent sections. Several of the plate end holding devices are then arranged in the cylinder channel or groove and are positioned adjacent each other. The forces exerted by the control assembly against each one of the plate end holding devices can differ from each other.

15 Claims, 15 Drawing Sheets

CYLINDER WITH RETAINING DEVICE AND A CONTROL ASSEMBLY FOR CONTROLLING THE FORCE EXERTED ON THE RETAINING DEVICE

CROSS REFERENCE TO RELATED APPLICATIONS

This application is the U.S. national phase, under 35 U.S.C. 371, of PCT/EP2008/063613, filed Oct. 10, 2008; published as WO 2009/068359 A1 on Jun. 4, 2009, and claiming priority to DE 10 2007 047 892.7, filed Nov. 29, 2007, the disclosures of which are expressly incorporated herein by reference.

FIELD OF THE INVENTION

The present invention is directed to a cylinder of a printing press, with at least one channel extending in the axial direction below the outer surface of the cylinder. A retaining device is located in the channel and exerts a force on at least one end of dressing or a packing that is positionable on an outer circumferential surface of the cylinder. At least one control assembly is also provided in the channel and, in its activated, operational state, counteracts a force exerted by the retaining device. This force which can be exerted by the control assembly can be adjusted between maximum and minimum values.

BACKGROUND OF THE INVENTION

A cylinder of a printing press, and having at least one channel extending in the axial direction and below the outer surface of the cylinder, is known from DE 102 44 574 A1. A retaining device which is located in the channel, exerts a force on at least one end of a packing that is positioned, or that is to be positioned on the outer surface of the cylinder. At least one control device is assigned to the retaining device. When the at least one control device is in its actuated operating state, it counteracts the force which is exerted by the retaining device on the at least one end of the packing which is positioned or which is to be positioned on the outer surface of the cylinder. The force that is exerted by the control assembly can be adjusted to a value that is different from its minimum value or its maximum value.

A device for fixing at least one packing on a cylinder of a rotary printing press is known from WO 03/091024 A1. The cylinder has at least one channel, with its opening directed toward the outer surface of the cylinder, and having a first wall and a second wall. At least one spring element and one clamping element are provided in the channel for use in clamping at least one leg of an end of the packing which has been inserted into the opening, that inserted end being the trailing end in the production direction of rotation of the cylinder. The clamping element is embodied as a pivotable lever with a first end and with a second end. The clamping element is seated in a bedding position, with its second end opposite the opening. The spring element is supported, at a support position, in such a way that the spring element exerts a force on the clamping element. The first end of the clamping element, either indirectly or directly clamps, in a clamping position, at least the leg that is placed against the first wall of the opening. At the same time, the spring fixes the second end of the clamping element in its bedding position by virtue of a counter force which is exerted at the clamping position.

WO 2004/002742 A1 describes a cylinder of a printing couple of a rotary printing press with one or more packings arranged on the outer surface of the cylinder. An axial length of the cylinder is subdivided into multiple, successive sections. In one or more of these sections, one or more packings are arranged in the circumferential direction of the cylinder. The width of each such packing corresponds to the width of one or more sections. At least two channels are provided, and are arranged offset from one another on the outer surface of the cylinder. Each channel extends in the axial direction of the cylinder below its outer surface. Each channel has an opening to the outer surface of the cylinder in the area of at least one section. At least one channel in at least one section extends below a packing, which is arranged on the outer surface in that section. For the purpose of fixing the packings in the channels in those sections in which at least one end of at least one packing extends through an opening in the respective channel, multiple base elements, each with a retaining device for the end of the packing, are arranged side by side in the axial direction. In the at least one channel that extends at least in one section below a packing which is arranged on the outer surface of the cylinder in this section, in place of the base element, multiple spacer elements are arranged side by side in the axial direction, without a retaining device in this section that extends under the packing.

SUMMARY OF THE INVENTION

The object of the present invention is to provide a cylinder for a printing press, with at least one channel extending in the axial direction of the cylinder below its outer surface. A packing, which is positioned on the outer surface of the cylinder is secured. However, its position can still be adjusted.

The object of the present invention is attained by the provision of a cylinder with at least one axially extending channel located below its outer surface. A retaining device is located in the channel and is adapted to exert a force on at least one end of a packing that is positioned on the cylinder's outer surface. At least one control assembly is provided which, in its actuated, operating state, counteracts the force exerted by the retaining device on the end of the packing. The force exerted by the control assembly can be adjusted to a value different from its minimum and maximum values. The outer surface of the cylinder can be divided axially into a plurality of sections arranged side by side. A plurality of retaining devices are arranged in the channel in at least one of these sections. The action of the control device, with respect to these retaining devices, is segmented so that the control assembly acts on only a partial number of the retaining devices in the channel.

The benefits to be achieved with the present invention consist especially in that a retaining device, which is positioned in a cylinder of a printing press, has not only the two operating positions "open" and "closed". At least one additional operating position is provided, in which an additional operating position packing that is positioned on the outer surface of this cylinder is secured, but its position can still be adjusted. The "open" operating position is one in which the retaining device is exerting no, or its minimum, clamping action. In the "closed" operating position, the retaining device exerts its full, or maximum clamping action. In the operating position of the retaining device, which operating position is referred to as "securing," and which is different from the aforementioned "open" and "closed" operating positions of the retaining device, a packing, which is positioned on the outer surface of this cylinder, can still be displaced axially, for example, and can be aligned. The clamping force that is acting on at least one end of this packing is substantially reduced not only within a narrowly defined axial section of this cylinder, but over its entire length, for example. In this manner, printing blankets which may be arranged, in particular, side by side on a transfer cylinder can be more easily joined to one another along their butt joints, which butt joints extend in the circumferential direction of the transfer cylinder. The level of clamping force, which is reduced with respect to its maximum value, is sufficient to hold the packing on the outer surface of this cylinder, which is rotating at only a very low speed—if at all. Rotation of this cylinder, at its production speed, is not permissible in this new operating mode. The reduced clamping force of the retaining device in this new operating mode is much lower than the centrifugal force that is applied to the packing end at the production speed of the cylinder.

In a cylinder, having a channel that is continuous in its axial direction, the solution of the present invention offers the advantage that packings of any width can be arranged on the outer surface of this cylinder, and are limited only by the maximum surface length of the cylinder. Only a single compressed air supply is required per cylinder, or at least per each channel of the cylinder. Even if multiple packings, which may be arranged side by side on the cylinder, will be changed, only a single actuation of the retaining devices located in a specific channel is necessary. Multiple actuations are not needed. Cylinders, in accordance with the present invention, and which can be covered with packings of any width, symmetrically and asymmetrically, offer a major advantage in the production of printed products. The same cylinder can optionally be covered with one printing blanket or with two or with three blankets, for example. This variability is advantageous because the system can react most easily, such as, for example, to a change in the width of a print substrate during production, without the need for reconfiguring the relevant cylinder.

The solution in accordance with the present invention also simplifies the cylinder in terms of its production. Continuous channels can be produced more easily, for example by drilling or cutting a groove, than can channels which may be arranged offset from each other in sections. The solution of the present invention also simplifies the distribution of compressed air in the relevant cylinder. The cylinder requires only a single compressed air port rather than multiple ports.

BRIEF DESCRIPTION OF THE DRAWINGS

Preferred embodiments of the present invention are illustrated in the set of drawings and will be specified in greater detail below.

The drawings show.

DESCRIPTION OF THE PREFERRED EMBODIMENT

Figure 1:
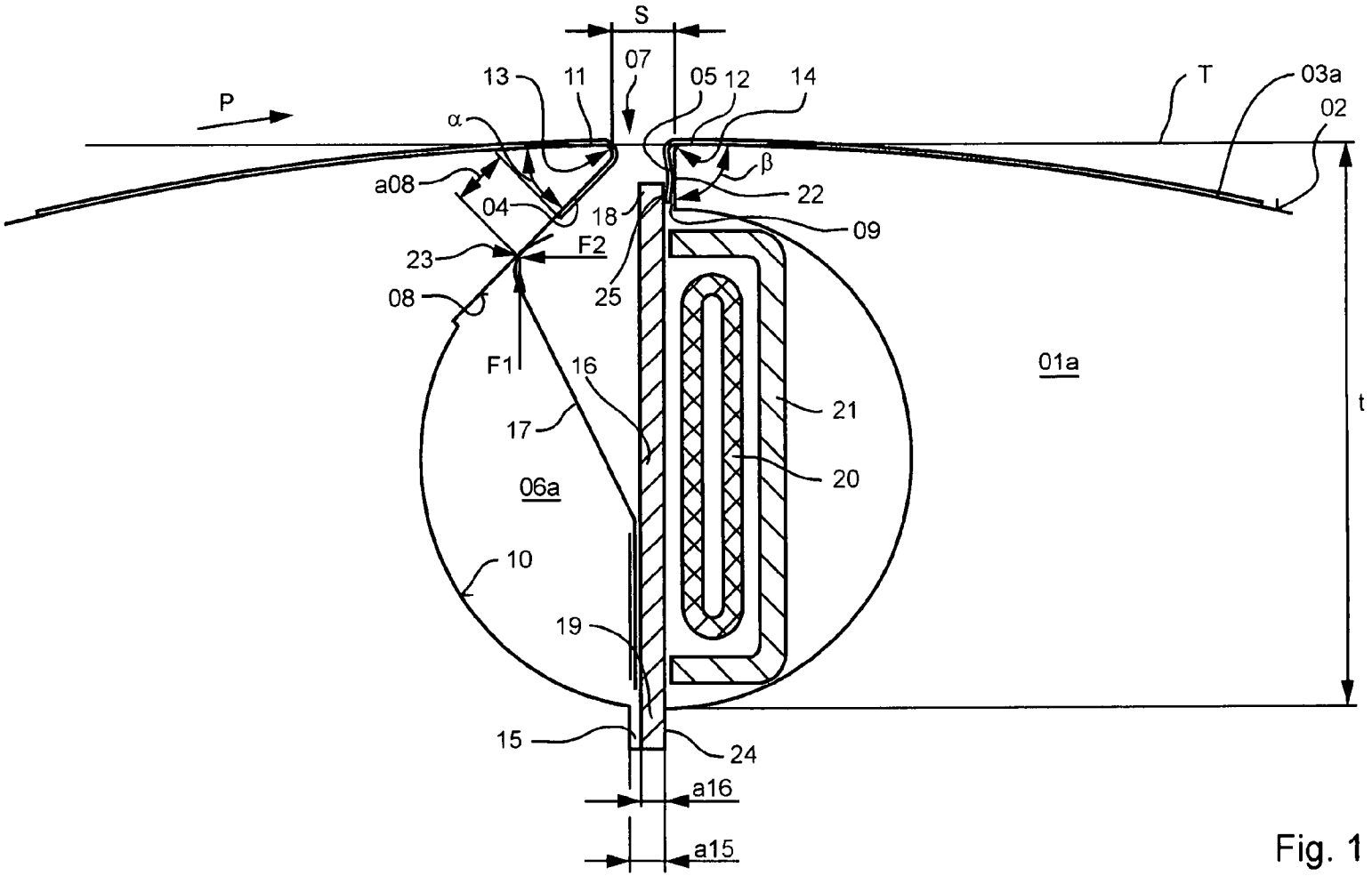
FIG. 1 a schematic, end view of a device for mounting a plate-type printing forme on a forme cylinder.

In accordance with a first preferred embodiment of the present invention, as represented in FIG. 1, a packing 03*a*, such as, for example, a plate-type, preferably flexible, printing forme 03*a*, is mounted on an outer surface 02 of a cylinder 01*a*, such as, for example, a forme cylinder 01*a*. Bent or angled legs 04; 05, which are located on the ends of the packing 03*a*, are inserted into a channel 06*a* which is located in the cylinder 01*a* and below its outer surface 02, which channel 06*a* has an opening 07 directed toward the outer surface 02 of the cylinder 01*a*. The legs 04; 05 are positioned in the opening 07 essentially against spaced walls 08; 09 of the opening 07, and near the outer surface 02 of the cylinder 01*a*. The thickness of the printing forme 03*a* is about 0.15 mm to 0.9 mm, for example, and in particular is between 0.2 mm and 0.5 mm, and preferably is approximately 0.3 mm. To some extent, the bent legs 04; 05 of the printing forme 03*a* can also rest against the wall 10 of the channel 06*a* that is radially interior of the area of the opening 07 and lies deeper inside the cylinder 01*a*. This is because the boundary between the walls 08; 09 of the opening 07 and the wall 10 of the channel 06*a* is somewhat arbitrary and difficult to define. This discussion is intended merely to indicate that the insertion depth of the legs 04; 05 is not precisely defined. Instead, it encompasses a larger tolerance range. The channel 06*a* can have different cross-sectional geometries without this negatively impacting the invention. However, a circular cross-section of the channel 06*a*, as shown in the several drawing figures, is favorable in terms of production engineering. In another variation of the present invention, the channel 06*a* may have a rectangular cross-section, for example.

Without limiting the invention to the following somewhat simplified representation, the description of the subject invention will assume in the subsequent discussion any, for the purpose of simplicity, that only a single packing or dressing 03*a* that wraps around the cylinder 01*a* will be fixed on the cylinder 01*a*. It will be readily understood that multiple packings 03*a* can be securable on the cylinder 01*a* in accordance with the present invention, which is to be described here, both in the cylinder's axial direction and in its circumferential direction. In the case of multiple packings 03*a*, which may be fixed in the circumferential direction of the cylinder 01*a*, multiple channels 06*a* are also provided.

With respect to a production direction P of the cylinder 01*a*, as indicated by the arrow in FIG. 1, the packing 03*a*, which is to be fixed on the outer surface 02 of this cylinder 01*a*, has a leading end 11 and a trailing end 12, with each such end being provided with a bent leg 04; 05. As viewed in the production direction P of the cylinder 01*a*, the opening 07 of the channel 06*a* also has a front edge 13, from which front edge 13 a first wall 08 extends to the channel 06*a*. The channel opening 07 also has a rear edge 14, from which rear edge 14 a second wall 09 also extends to the channel 06*a*. The channel opening 07 is long and narrow on the outer surface 02 of the cylinder 01*a*, and is thus embodied as a slit. A slit width S of the opening 07 on the outer surface 02, of the cylinder 01*a* and which slit width S is oriented in the circumferential direction of the cylinder 01*a*, is small as compared with a depth t of the channel 06*a*. The dimensions of the channel opening 07 are such that a leg 04 of a leading end 11 of a packing 03*a* and a leg 05 of a trailing end 12 of the same, or, if multiple packings 03*a* are fixed in the circumferential direction of the cylinder 01*a*, the legs of a similar packing 03*a*, can be arranged in the channel opening 07 one after the other. Slit widths S of less than 5 mm, and preferably ranging in width from 1 mm to 3 mm, are advantageous. The depth t of the channel 06*a* is between 20 mm and 50 mm, for example, and is preferably between 30 mm and 35 mm.

An acute angle α is formed between the first wall 08 that extends from the channel opening front edge 13 to the channel 06*a* and an imaginary tangent T lying on the outer surface 02 of the cylinder 01*a* over the opening 07. This acute angle α, which is so formed measures between 30° and 70°, for example, and in particular, measures between 40° and 50°, and most preferably is 45°. An area, which is extending from the channel 06*a* to the opening 07, narrows toward the outer surface 02 of the cylinder 01*a*, or, in an opposite view, widens from the outer surface 02 toward the interior of the channel 06*a*. The leg 04 of the leading end 11 of the packing 03*a* can be suspended, for example, at the front edge 13 of the channel opening 07, such that this leading dressing and leg 04 preferably is received in a positive connection against the wall 08 that extends from the front edge 13 to the channel 06*a*. In the embodiment depicted in FIG. 1, the second wall 09, located at the rear edge 14 of the opening 07, slopes downward approximately vertically toward the channel 06*a*. The second wall 09 can also be inclined slightly, however, so that the area extending from the opening 07 to the channel 06*a* also widens. An angle β, acts as an opening angle between the wall 09 extending from the rear edge 14 to the channel 06*a* and the above-mentioned tangent T that lies on the outer surface 02 of the cylinder 01*a* over the opening 07. This angle β ranges, for example, from 60° to 120°, and in particular, from 80° to 95°, and it preferably measures 90°.

The channel 06*a* ordinarily extends parallel to the axis of rotation of the cylinder 01*a*. Approximately diametrically opposite to the slit-type opening 07 on the surface 02 of the cylinder 01*a*, a recess, such as, for example, a groove 15, is located in the wall 10 of the channel 06*a*, for example. A plate-type, rigid, retaining assembly 16, which is preferably movable, is adjustably and pivotably mounted in the groove 15. The groove 15 accordingly serves as bedding position 24 and as a support position 24 for the retaining assembly 16, which is preferably embodied as a lever. To allow the retaining assembly 16 to pivot in the groove 15, a width a15 of the groove 15 is embodied as being at least slightly larger than a thickness a16 of the retaining means 16. As an alternative location for the bedding position 24 for the retaining assembly 16, which is shown in FIG. 1, and in which the bedding position 24 is precisely diametrically opposite the opening 07, the bedding position 24 may alternatively be located on the wall 10 and still in the area of the base of the channel 06*a*. It will then be offset clockwise by up to about 30° from a vertical line extending from the opening 07 on the side that faces the front edge 13, in particular, with an angle of between 15° and 20° being advantageous. Such an offset position of the bedding position 24 for the retaining assembly 16 can be seen in FIG. 2.

The retaining assembly 16 is embodied such that it has a first, upper end 18, which can be placed against one of the two walls 08 or 09 of the channel opening 07, and a second, lower end 19, which is opposite the channel opening 07. At least one spring element 17, such as, for example, a compression spring 17, which may be embodied as a leaf spring 17, is attached to the retaining assembly 16. This spring element 17 is preferably supported directly against the wall 08 that extends from the front edge 13 of the channel opening 07 or against the wall 10 of the channel 06*a* in such a way that the pivotably mounted second, lower end 19 of the retaining assembly 16 is thereby fixed in its bedding position 24, in the groove 15. At the same time, the first, upper end 18 of the retaining assembly 16 is pressed against the wall 09 that extends toward the rear edge 14 of the opening 07, thereby forming a clamping position 25 at the first, upper end 18 of the retaining assembly 16. The retaining assembly 16, and the at least one spring element 17 thus cooperate to form a retaining device acting in the channel 06*a*. The retaining assembly 16 preferably cooperates with multiple spring elements 17 simultaneously.

The at least one spring element 17 is preferably prestressed and thus stabilizes the retaining assembly 16, in its position in the channel 06*a*, and secures the retaining assembly 16, for example, against inadvertently falling out of the channel opening 07 during a rotation of the cylinder 01*a*. To achieve its simultaneous clamping and securing functions, it is necessary for the at least one spring element 17 to exert a force of a sufficient degree to be able to secure the retaining assembly 16 in its bedding or support position 24, in particular, by forcing it into its bedding position 24, by virtue of the support of the spring element at its support position 23, and in particular, by the location and/or by the shape of this support position 23.

The support position 23 of the at least one spring element 17 is preferably located spatially closer to the channel opening 07 than it is to the bedding or support position 24 of the retaining assembly 16. Securing of the retaining assembly 16 in place is achieved in a simple manner. The at least one spring element 17 is preferably supported against the first wall 08 that extends from the front edge 13 of the channel opening 07 or is positioned against the wall 10 of the channel 06*a*, and preferably is in direct contact with that wall 08; 10. In the support position 23 of the at least one spring element 17, forces or force components F1; F2 are received simultaneously in two directions which extend perpendicular to one another in the cross-sectional plane of the channel 06*a*. This reception of forces F1; F2 is made possible by the fact that the support position 23 is located, in particular, where the wall 08, which is extending from the front edge 13 into the channel 06*a*, forms an inclined surface facing the bedding or support position 24 for the retaining means 16. This is due to the acute angle α of the opening 07. On these inclined surfaces, two force components form in the support position 23 of the at least one spring element 17, each one acting as a counter force to the respective support force components F1; F2. One force component, acting as a counterforce to the force component F2, applies the force which is necessary for clamping the leg 05 inserted into the opening 07. The other force component acts in the direction of the bedding position 24 for the retaining assembly 16, thereby forcing that retaining assembly 16 into the groove 15, thereby stabilizing it in its position when the cylinder 01*a* is rotated. In an alternative embodiment to the inclined surfaces, the wall 08 that extends from the front edge 13 can have a recess, or can be shaped such that the distribution of forces described above can occur in the support position 23 of the at least one spring element 17. In place of a leaf spring 17, a corresponding helical compression spring 17 may be used, and which would be positioned accordingly in the channel 06*a*. The support position 23 of the spring element 17 is preferably located directly on the wall 08. If the leading end leg 04 of the packing or dressing 03*a* is longer in configuration, this support position 23 of the spring element 17 can also be located on this leg 04, so that the at least one spring element 17 is supported indirectly against the wall 08. In this latter case, the at least one spring element 17 is not in direct contact with the wall 08. However, the same distribution of forces, as was described above, is still present. For the retaining assembly 16, a degree of vertical play can be permitted in the groove 15, as long as it is ensured that the retaining assembly 16 will not become released from the opening 07 in any operating situation, and is capable of performing its intended clamping function.

In the embodiment which is represented in FIG. 1, the support position 23 for the at least one spring element 17 is located on the wall 08 that extends from the front edge 13 of the channel opening 07 to the channel 06*a*, directly downstream of the end of the leg 04 on the leading end 11 of the packing 03*a*, which packing or dressing leading end leg 04 is suspended from the front edge 13, and facing the channel 06*a*. A distance a08 between the end of the leg 04 and the support position 23, as seen in FIG. 1, is preferably less than 5 mm, and in particular, is less than 3 mm. Multiple retaining assemblies 16 are preferably arranged in the longitudinal direction of the channel 06*a*, which is in the axial direction of the cylinder 01*a*, each such retaining assembly 16 being provided with at least one allocated spring element 17. However, only a single retaining assembly 16 is located in each cross-sectional plane of the channel 06*a*.

At least one control device 20, which is preferably situated in the channel 06*a*, counteracts the contact pressure that is exerted in a contact surface on the wall 09, which wall 09 extends from the rear edge 14 of the opening 07. That contact pressure is exerted by the at least one spring element 17 through the retaining assembly 16. Counter action of the force that is active there, so as to release, as needed, the clamping force effected on the dressing or packing trailing end 12 by the retaining assembly 16 engaging on the wall 09 is accomplished by actuating this at least one control device 20. The at least one control device 20 is preferably configured as a hose 20 which is preferably made of a flexible material, such as, for example, a plastic or rubber, with such a hose 20 extending in the longitudinal direction of the channel 06*a*. The hose 20 can be pressurized by the introduction of a pressure medium, such as, for example, compressed air, into its interior, and as a result, can be extended at least in its radial direction. The hose 20 can be enclosed inside an abutment 21. The abutment 21 for the control device or hose 20 is, in this case, a housing, which housing is supported against the wall 10 of the channel 06*a*. Housing or abutment 21 is provided having its shaping reducing the volume expansion of the hose 20 that is necessary for releasing the clamping force, thereby contributing to a shorter reaction time for the control device or hose 20. In another implementation of the at least one control device 20, an abutment 21, in the form described here, may be dispensed with.

Figure 13:
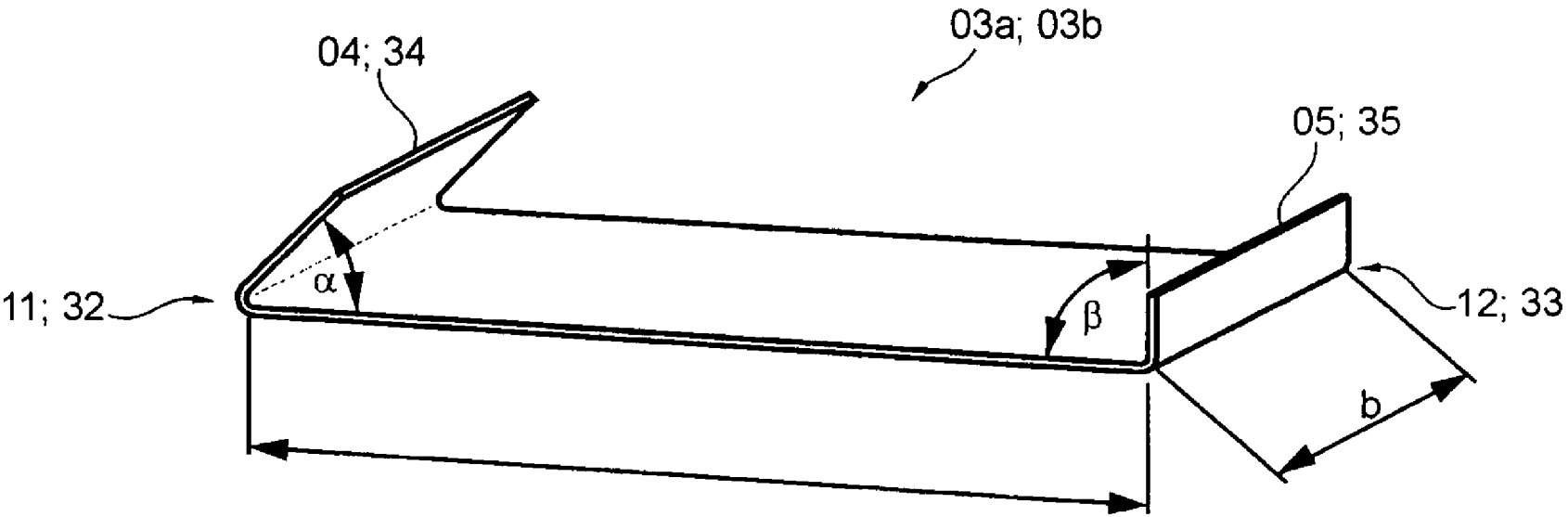
FIG. 13 a perspective view of one of the packings, to be held by a retaining device on the cylinder, in its longitudinal extension.

The embodiment which is shown in FIG. 1, further shows that the leg 05 of the trailing end 12 of the packing or dressing 03*a* can be embodied as a rocker. This rocker is supported at its bedding position 22, against the wall 09 of the opening 07, once the leg 05 has been inserted into the opening 07 to the channel 06*a*. Regardless of the geometry of the edge 14 of the opening 07, and against which a leg 05 of the trailing end 12 of the packing 03*a*, which leg 05 is embodied as a rocker, is placed, it is also possible for the bedding position 22 of the rocker to be located on the wall 10 of the channel 06*a*. The packing or dressing 03*a* thus has a bent leg 05 at its trailing end 12, which trailing end 12 is shaped in such a way that this leg 05 has an additional bent leg section, projecting from the wall 09 at an acute angle of 15°, for example, which bent leg section can be tilted in the bedding position 22 on the wall 09 of the opening 07. This tilting is thereby effective for reversing the direction of action of the clamping of the leg 05 on the trailing end 12, and for generating a tensile stress for the packing 03*a*, which is positioned on the outer surface 02 of the cylinder 01*a*. That tensile stress draws the trailing end 12 of the packing 03*a* in the direction of the front edge 13 of the channel opening 07. The location of the bedding position 22 for the rocker, which is located on the trailing end 05 of the packing or dressing 03*a*, can be chosen such that, in a space between the bedding position 22 for the rocker and the bent section of the leg 05 on the edge 14 of the opening 07, a lever arm is produced. The lever arm so produced is twice as long as the lever arm between the bedding position 22 for the rocker and the clamping position 25 which is defined between the leg 05 and the retaining means 16. The advantage of this solution is that manufacturing tolerances in the length l of the packing 03*a*, which length L is oriented in the circumferential direction of the cylinder 01*a*, as seen in FIG. 13, can be easily adjusted. Packings 03*a* that are positioned circumferentially along the cylinder 01*a*, and having no or only insufficient tensile stress exerted on the outer surface 02 of the cylinder 01*a*, tend to shift on the outer surface 02 of the cylinder 01*a* when the cylinder rotates. Moreover, if a packing or dressing 03*a* does not rest with its entire surface against the outer surface 02 of the cylinder 01*a*, a break in that packing or dressing can occur, for example, at its trailing end 12, as a result of the walking action exerted on it when the cylinder 01*a* is in the production process. In the example shown in FIG. 1, the retaining assembly 16 clamps the packing 03*a* not only in the above-described manner. In addition, the packing 03*a* is also held by the leg 05 which is embodied as a rocker. With a corresponding prestressing of the at least one spring element 17, the rocker of the leg 05 and the at least one spring element 17 cooperate and combine with the retaining assembly 16 for the packing 03*a* to form a tension regulating system, which automatically compensates for a change in the length of the packing 03*a*.

Figure 2:
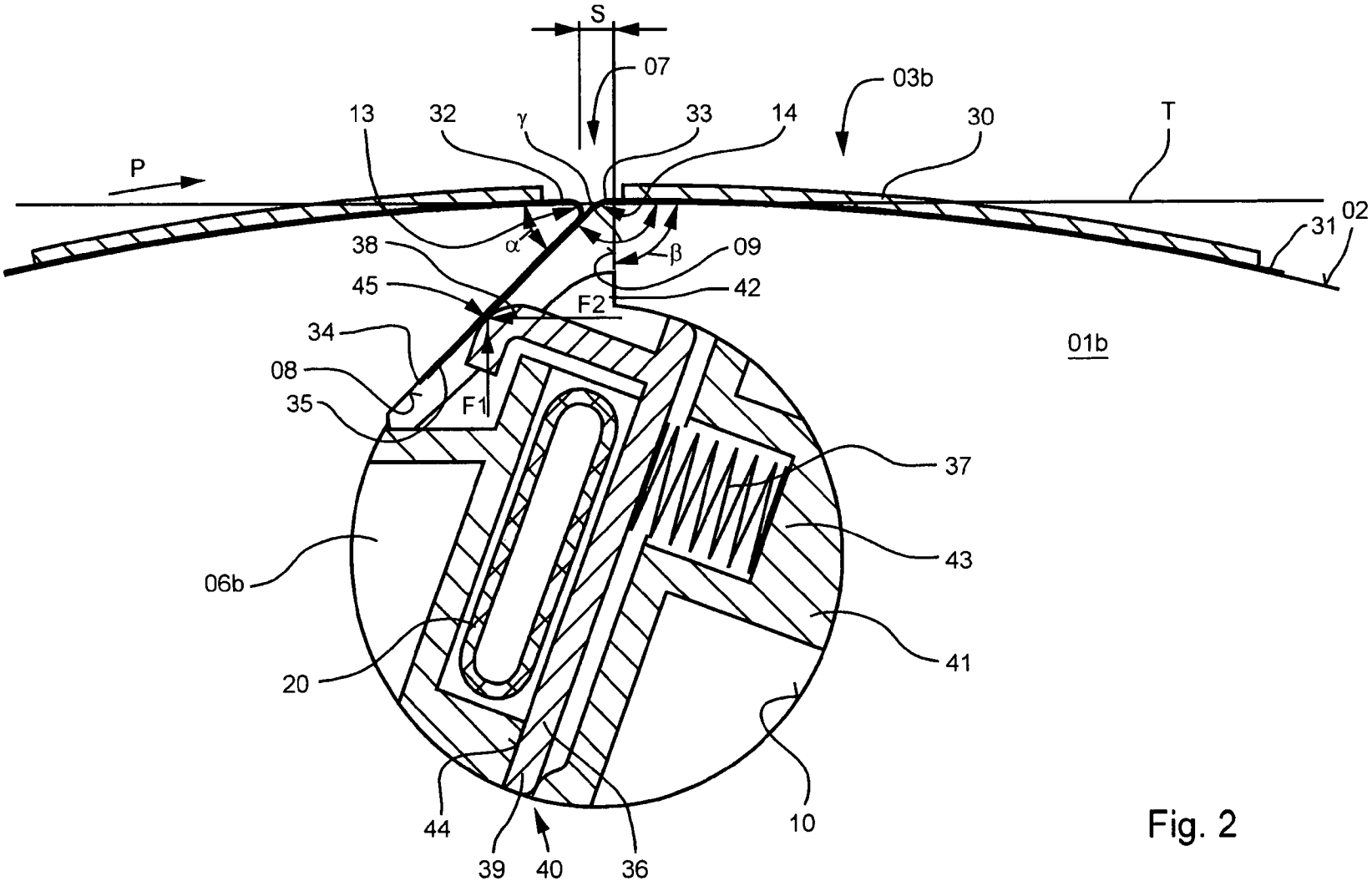
FIG. 2 a schematic depiction of a device for mounting a printing blanket, for use in transferring a printed image, on a transfer cylinder.

As a further embodiment, FIG. 2 shows a device which is usable for fixing a printing blanket 30 to a transfer cylinder 01*b* and that will transfer a printing image located on a cylinder 01*b*, which may be, for example, a transfer cylinder 01*b* of an offset printing press. The printing blanket 30 is attached to a carrier plate 31 which is positioned on the outer surface 02 of the cylinder 01*b*, which carrier plate 31 is flexible but which is also stable with respect to its surface extension. The carrier plate 31 has bent legs 34; 35 at its two opposite ends that will be fixed to the transfer cylinder 01*b*. The legs can be inserted into a channel 06*b* which is located in the cylinder 01*b* and which is provided with an opening 07 that is directed toward the outer surface 02 of the cylinder 01*b*. The packing or dressing 03*b*, which is used here, is ordinarily a complex layered structure, consisting at least of a carrier plate 31 and a printing blanket 30 attached thereto. A printing blanket 30 having a metal carrier plate 31, for example, is also referred to as a metal printing blanket 30. The thickness of the layered structure of the printing blanket 30 is between 1.5 mm and 3 mm, for example, and preferably is approximately 1.75 mm.

Similarly to the embodiment of the which is illustrated in FIG. 1, the carrier plate 31, which is to be fixed on the cylinder 01*b*, has a leading end 32 and a trailing end 33 in the production direction P of the cylinder 01*b*. In this embodiment as well, as viewed in the production direction P of the cylinder 01*b*, the opening 07 of the channel 06*b* has a front edge 13, with a first wall 08 that extends in the channel 06*b*, and has a rear edge 14, with a second wall 09 that also extends in the channel 06*b*. Between the first wall 08 that extends from the front edge 13 to the channel 06*b*, and an imaginary tangent T lying on the outer surface 02 of the cylinder 01*b* over the opening 07, an acute angle $\alpha$ is also formed. This acute angle $\alpha$ measures between 30° and 70°, for example, and in particular measures between 40° and 50°, and preferably is 45°. The leg 34 of the leading end 32 of the carrier plate 31 rests in a positive connection against the first wall 08, which extends generally radially inwardly from the front edge 13. In contrast to the embodiment shown in FIG. 1, however, in this embodiment the leg 35 of the trailing end 33 of the carrier plate 31 preferably also rests against the first wall 08, and specifically rests, over the majority of its surface and preferably in a non-positive connection, directly on the leg 34 of the leading end 32 of the carrier plate 31. The leg 35 of the trailing end 33 of the carrier plate 31 is thus bent at an obtuse angle $\gamma$, which obtuse angle $\gamma$ measures between 120° and 150°, for example, in particular measures between 130° and 140°, and preferably measures $\gamma \cong 135°$. The wall 09 that extends from the rear edge 14 to the channel 06*b*, and the above-mentioned tangent line T that lies on the outer surface 02 of the cylinder 01*b* over the opening 07, together form an angle $\beta$ as in the above-described embodiment shown in FIG. 1, which angle $\beta$ measures between 60° and 120°, in particular measures between 80° and 95° and is preferably nearly a right angle, such as, for example, 89°.

A rigid clamping element 36, which is equipped, in this example, with a projecting arm, has a first or upper end 38 and a second or lower end 39. The second or lower end 39 is pivotably mounted in a bedding position 40 which is preferably situated near the base of the channel 06*b*. The bedding position 40 is embodied as a recess in a base element 41, for example, and the recess has a support surface 44 for the lower end 39 of the clamping element 36, for example. The bedding position 40 of the clamping element 36, as was previously described in connection with the first embodiment, can deviate clockwise on the side that faces the front edge 13 by up to approximately 30° from a vertical line extending radially inwardly from the opening 07. In particular, an angle of between 15° and 20° can be advantageous. The base element 41 is preferably secured against rotation in the channel 06*b*. The base element 41 can be made of a plastic or of a metal material. If multiple rigid clamping elements 36 are provided in the longitudinal direction of the channel 06*b*, these clamping elements 36 are preferably each positioned in a separate base element 41. A group of these base elements 41 are usually arranged in a row in the channel 06*b*.

At least one spring element 37, which may be, for example, a helical compression spring 37 or a leaf spring 37, which is preferably encompassed by the base element 41, and which is supported in that base element 41, for example, against a support position 43 and, working together with the clamping element 36, forms a retaining device. That spring 37, through the clamping element 36, exerts a force, such as, for example, a contact pressure in the contact surface, via the first or upper end 38 of the clamping element 36, on the legs 34 and 35 that lie one on top of the other on the wall 08 of the front edge 13. This contact pressure is sufficient for clamping the two legs 34 and 35 against the first wall 08. The first or upper end 38 of the clamping element 36 is supported at the clamping position 45 between the clamping element 36 and the leg 35 at the trailing end 33 of the carrier plate 31 of the packing 03*b* on the wall 08 that extends from the front edge 13 of the opening 07 or on the wall 10 of the channel 06*b*. Clamping forces F1; F2 are received simultaneously in two directions, and extending perpendicular to one another, in the cross-sectional plane of the channel 06*b*. Due to the acute angle $\alpha$, the clamping position 45 again lies on an inclined surface. In this embodiment, the clamping position 45 is accordingly located on the area of the wall 08 that is covered by the two legs 34 and 35 that lie one on top of the other. The retaining device with the pivotably mounted clamping element 36, and in particular, having the bedding position 40 of the clamping element 36, thus remains stationary in the channel 06*b* by virtue of its support and the associated distribution of forces.

The at least one spring element 37 is preferably prestressed and, particularly when combined with the securement of the base element 41 against rotation, by virtue of its force acting on the clamping element 36, serves to secure the clamping element 36 in its position through the application of a sufficiently large force component. In the embodiment which is shown in FIG. 2, the channel 06*b* has a circular cross-section. This cross-section could, however, also be rectangular in shape. The outer shape of the base element 41 is preferably configured to match the contours of the channel 06*b*, or is supported in at least three support positions against the wall 10 of the channel 06*b*. For example, an arrest mechanism 42, which is configured as a stop, which projects into the area extending up to the opening 07 and which is supported against the second wall 09 of the opening 07, for example, is located on the base element 41. This arrest mechanism 42 secures the base element 41 against rotation, especially in the circular channel 06*b*. Securing the relatively inexpensive base element 41, which may be made, for example, of a plastic, against rotation is advantageous, in particular, when a groove 15 for the retaining assembly 16 or the clamping element 36 is not provided in the channel 06*a*; 06*b*. This may be the situation, for example, because the inclusion of a groove 15 has been dispensed with for reasons of cost, for example. With a corresponding cross-sectional shape of the channel 06*b*, such as, for example, an angular shape, the base element 41 can also be structured such that it is supported against the wall 10 of the channel 06*b*, and is secured against rotation.

At least one control device 20 is provided in the base element 41, which controls device 20, when actuated, counteracts the force that is exerted by the at least one spring element 37 on the first wall 08 of the opening 07 via the clamping element 36. When the at least one control device 20 is actuated, the clamping force that is exerted by the clamping element 36 on the first wall 09 is at least partially released. The control device 20, which is preferably pneumatically actuated, for example, is again preferably a hose 20 which extends in the longitudinal direction of the channel 06*b*, and which can be pressurized with a pressure medium, such as, for example, with compressed air. The at least one control device 20 is preferably encompassed by the base element 41.

In this second embodiment, as well, it is assumed that only a single clamping element 36 is located in each cross-sectional plane of the channel 06*b*, orthogonal to the longitudinal axis. Throughout the longitudinal extension of the channel 06*b*, multiple such clamping elements 36, each with one or more allocated compression springs 37, can be arranged. Common to the two illustrated embodiments of FIGS. 1 and 2 is that in the channel 06*a*; 06*b* a retaining assembly 16 or a clamping element 36 is mounted on one side, so that it is pivotable at only one end 19; 39, and is preferably movable. Through the use of the at least one spring element 17; 37 that is functionally connected to the retaining assembly 16 or to the clamping element 36, the leg 05; 35 of the trailing end 12; 33 of the packing 03*a* or the carrier plate 31 is clamped. The retaining assembly 16 or the clamping element 36 is simultaneously secured in its bedding position 24; 40. The plate, dressing or packing end retaining device, which is comprised of the retaining assembly 16 or the clamping element 36 and the at least one spring element 17; 37, is secured in place. By incorporating the clamping position 25; 45 which exists between the retaining assembly 16 or the clamping element 36 and the leg 05; 35 of the trailing end 12; 33 of the printing forme or dressing 03*a* or of the carrier plate 31 of the printing blanket 30, the prestressing of the at least one spring element 17; 37 stabilizes the retaining assembly 16 or the clamping element 36 in the cross-sectional plane of the channel 06*a*; 06*b* and, if applicable, with the help of an arrest mechanism 42 which is formed on the base element 41, thereby preventing the retaining assembly from rotating. The bedding position of the retaining assembly 16 or the clamping element 36 allows the retaining assembly 16 or the clamping element 36 to pivot. However, the retaining assembly 16 or the clamping element 36 is stationary, with respect to its position in or in relation to the channel 06*a*; 06*b*, at least during the clamping process. In each embodiment, the at least one spring element 17; 37 or the retaining assembly 16 or the clamping element 36 is supported, either indirectly or directly, at a support position 23; 43 or at a clamping position 45, against the wall 08; 09 that is opposite the wall 08; 09 of the opening 07 and against which the arrest mechanism 43 is supported with its stop.

FIG. 1 and FIG. 2 therefore each show a device for use in fixing at least one packing 03*a* or at least one carrier plate 31 for a printing blanket 30 or the like onto a cylinder 01*a*; 01*b*, with a retaining device supported against the wall 10 of the channel 06*a*; 06*b* or against the walls 08; 09 of the opening 07, for example, non-rotatably, and also with a retaining assembly 16 or a clamping element 36 that is pivotably mounted in or on the base of the channel 06*a*; 06*b*. The retaining device is optionally situated in a base element 41. The at least one spring element 17; 37 or the clamping element 36, which, in its support position 23 or in its clamping position 45, accepts forces F1; F2 which are acting simultaneously in two directions that are perpendicular to one another in the cross-sectional plane of the channel 06*a*; 06*b*, and with resulting counter forces, simultaneously performs clamping and securing functions.

These devices, which are usable for fixing at least one packing 03*a* or one carrier plate 31 on a cylinder 01*a*; 01*b*, can be implemented in the same printing couple of a rotary printing press that is working in an offset printing process. A cylinder 01*a*, with a packing or dressing configured as a printing forme 03*a*, in accordance with the first preferred embodiment, rolls off against a cylinder 01*b* with a packing 03*b* in accordance with the second preferred embodiment. Thus, a plate-type printing forme 03*a* fixed to the outer surface 02 of the first cylinder 01*a* rolls off against a printing blanket 30, which is mounted on the outer surface 02 of the second cylinder 01*b* on a carrier plate 31. In this case, the cylinder 01*a*, in accordance with the first preferred embodiment, is a forme cylinder 01*a* and the cylinder 01*b*, in accordance with the second preferred embodiment, is a transfer cylinder 01*b*. Additionally, the retaining device, comprising a retaining assembly 16 and at least one leaf spring 17, for example, and which is arranged in the channel 06*a* of the forme cylinder 01*a*, can be encompassed by a base element 41, wherein recesses in the base element 41 enable the above-described pivotability and support of the retaining device.

This printing couple is then also characterized, for example, in that between the wall 09 that extends from the rear edge 14 of the channel opening 07 to the channel 06*a* of the forme cylinder 01*a*, and the tangent T, which is lying on the outer surface 02 of the forme cylinder 01*a* over the opening 07, an approximately right angle β is formed. The trailing end 12 of the printing forme 03*a* is held against the wall 09 that extends from the rear edge 14 of the channel opening 07 to the channel 06*a*. The leg 35 on the trailing end 33 of the carrier plate 31 is bent at an obtuse angle γ, with the tangent T lying on the opening 07 of the transfer cylinder 01*b*, and this trailing end 33 is held, together with the leg 34 on the leading end 32 of the carrier plate 31, against the wall 08 that extends from the front edge 13 of the channel opening 07 to the channel 06*b*.

Figure 3:
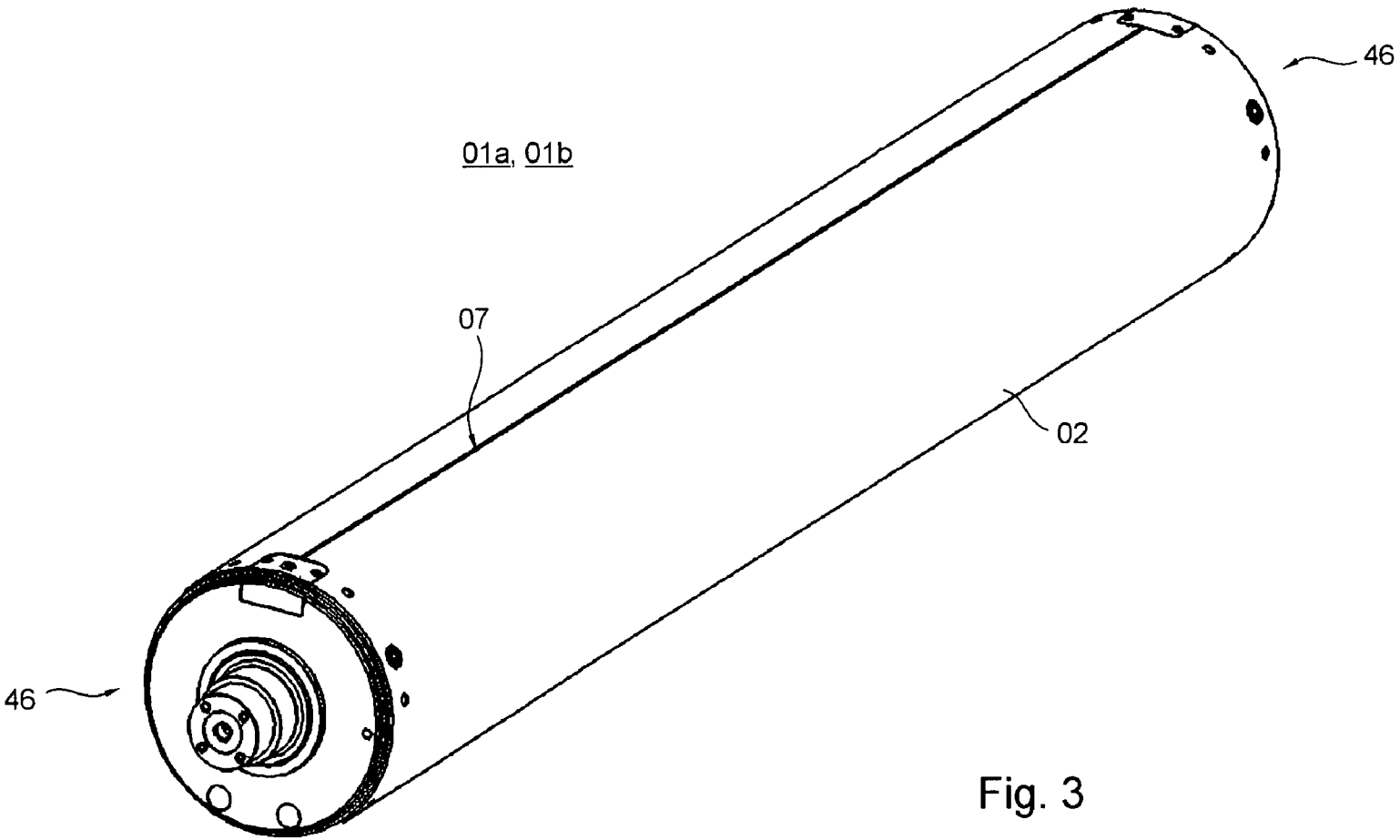
FIG. 3 a perspective view of one of the cylinders depicted in FIG. 1 or 2, and with a continuous, slit-type opening.

FIG. 3 shows a perspective representation of one of the cylinders 01*a*; 01*b* described above in reference to FIG. 1 or to FIG. 2. A slit-type opening 07, extending continuously along the length of the represented one of these cylinders 01*a*; 01*b*, is clearly visible. Because the opening 07 opens up into a channel 06*a*; 06*b*, which is located below the outer surface 02 of the cylinder 01*a*; 01*b*, this channel 06*a*; 06*b* also extends continuously from one end surface 46 of this cylinder 01*a*; 01*b* to its opposite end surface 46. The cylinder 01*a*; 01*b* may be embodied, for example, as a 4/2 or as a 6/2 forme cylinder 01*a*, with either four or six printing formes 03*a* arranged side by side in its axial direction, and with two printing formes 03*a* arranged one in front of the other in its circumferential direction, for example, or the cylinder 01*a*; 01*b* may be embodied as a 3/1 transfer cylinder 01*b* with three printing blankets 30 arranged side by side, with each such printing blanket 30 encompassing the entire circumference of the cylinder. The circumference of the respective cylinder 01*a*; 01*b* ranges between 280 mm and 410 mm, for example; its axial length can be between 1,000 mm and 2,600 mm, for example. The relevant cylinder 01*a*; 01*b* can be used in a 9-couple satellite printing unit or in an H-type printing unit, for example. The forme cylinder 01*a*, and a transfer cylinder 01*b* that cooperates with it, are each embodied, for example, as a double-circumference cylinder. A material web 59, such as, for example, a paper web 59, as is shown schematically in FIGS. 14 and 15 and which passes through the respective printing unit, is preferably used as the print substrate 59.

Figure 4:
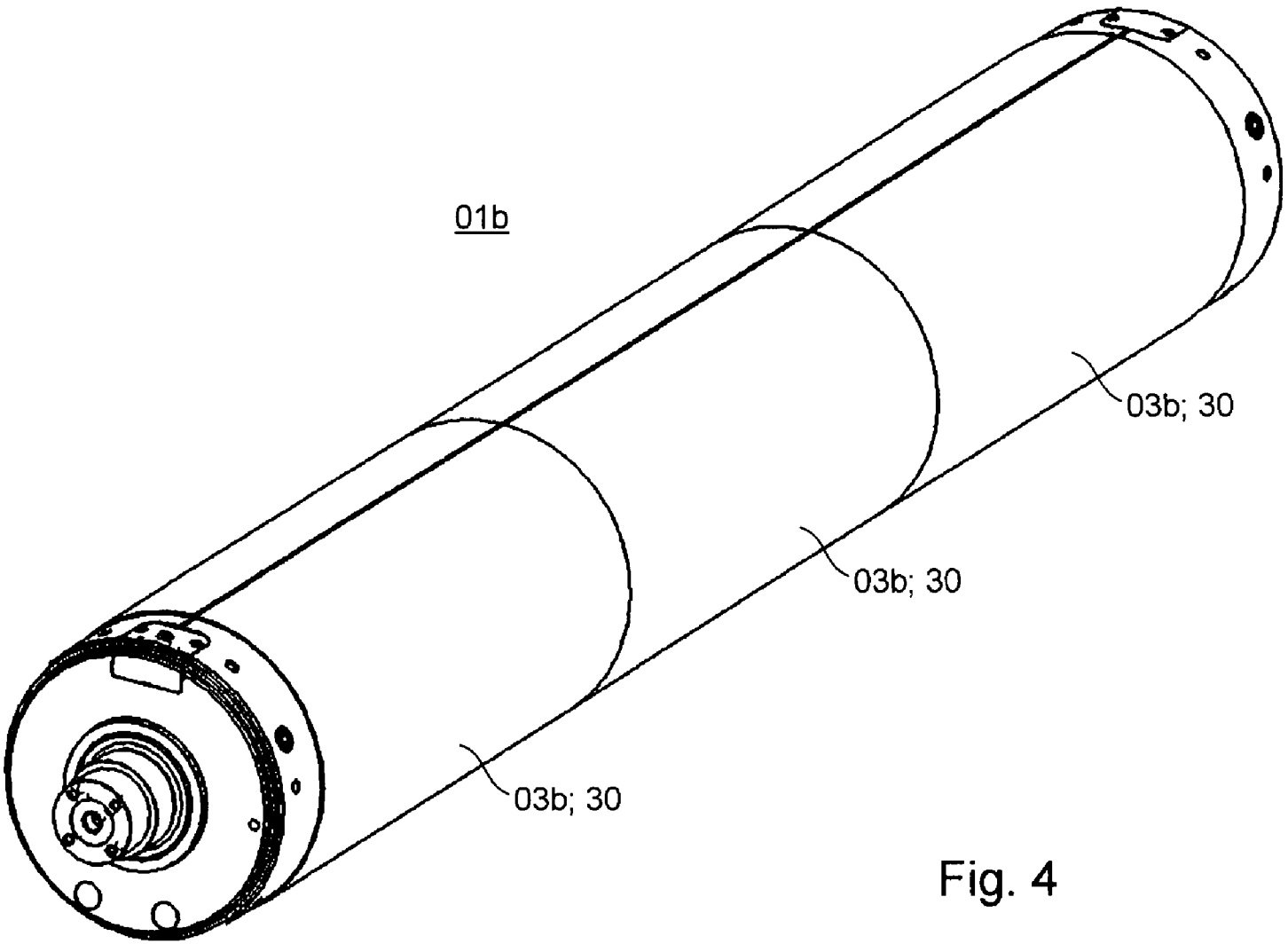
FIG. 4 a perspective view of the cylinder of FIG. 3 and schematically showing the cylinder covered with three packings.
Figure 5:
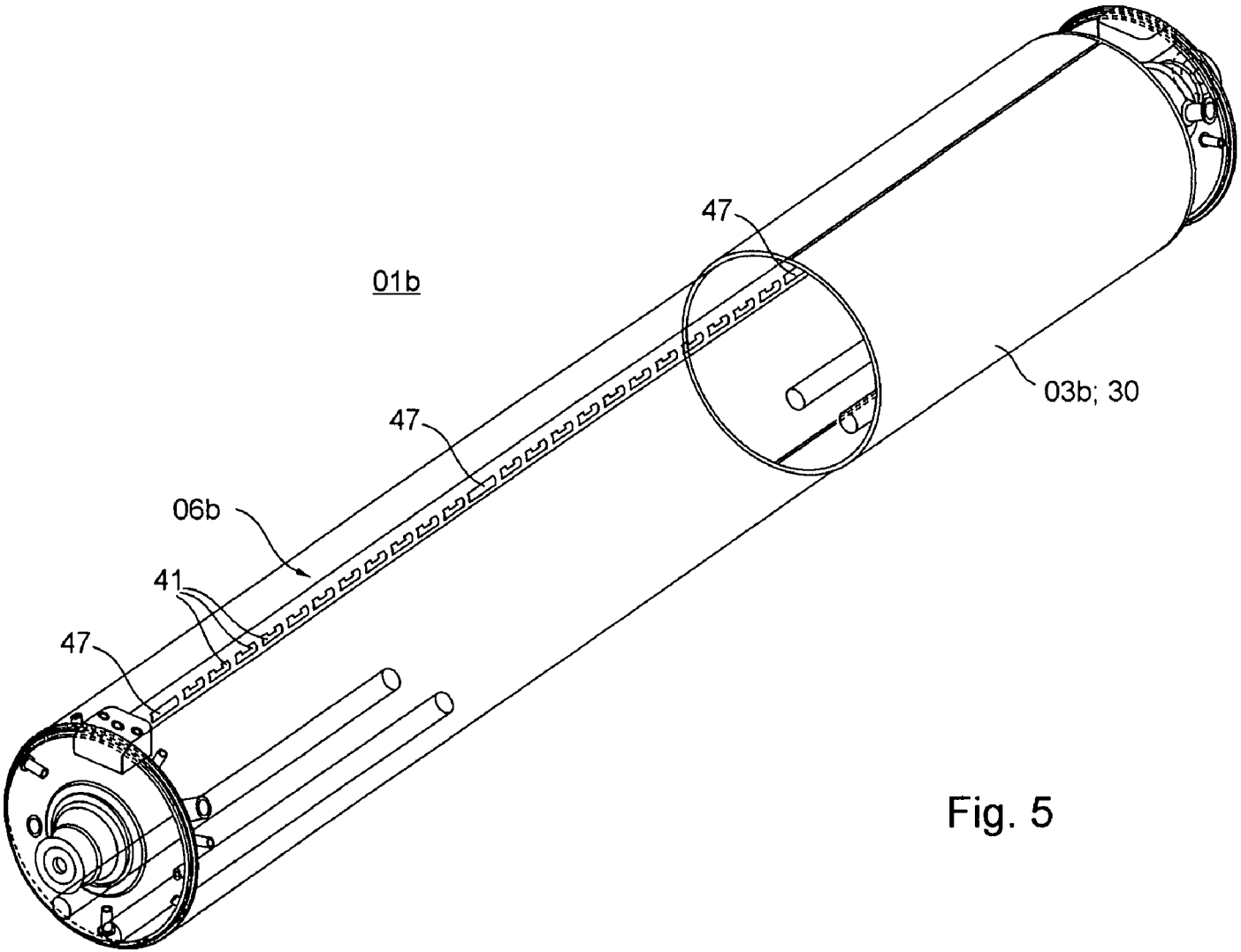
FIG. 5 a semi-transparent representation of the cylinder of FIG. 4.

FIG. 4 shows a variation of the cylinder 01*a*; 01*b* which is represented in FIG. 3. The cylinder 01*b*, shown in FIG. 4, is covered with three printing blankets 30, and in particular, is covered with three metal printing blankets 30, which are situated side by side in its axial direction. On this cylinder 01*b*, which is embodied in the depicted example of FIG. 4 as transfer cylinder 01*b*, three packings 03*b* are arranged, for example. FIG. 5 again shows the cylinder 01*b* of FIG. 4 but, in this depiction, in a semi-transparent representation, in which two of the three packings 03*b* or printing blankets 30 are not shown. In the part of the cylinder 01*b* which is depicted transparently, the continuous channel 06*b* is visible, and is provided with multiple base elements 41, all of which are arranged in this continuous channel 06*b*, and which are arranged, next to one another, in a row. Also arranged in the channel 06*b* are spacer elements 47, which are similar to the base elements 41 in their overall outer shape, but which have no retaining device.

Figure 6:
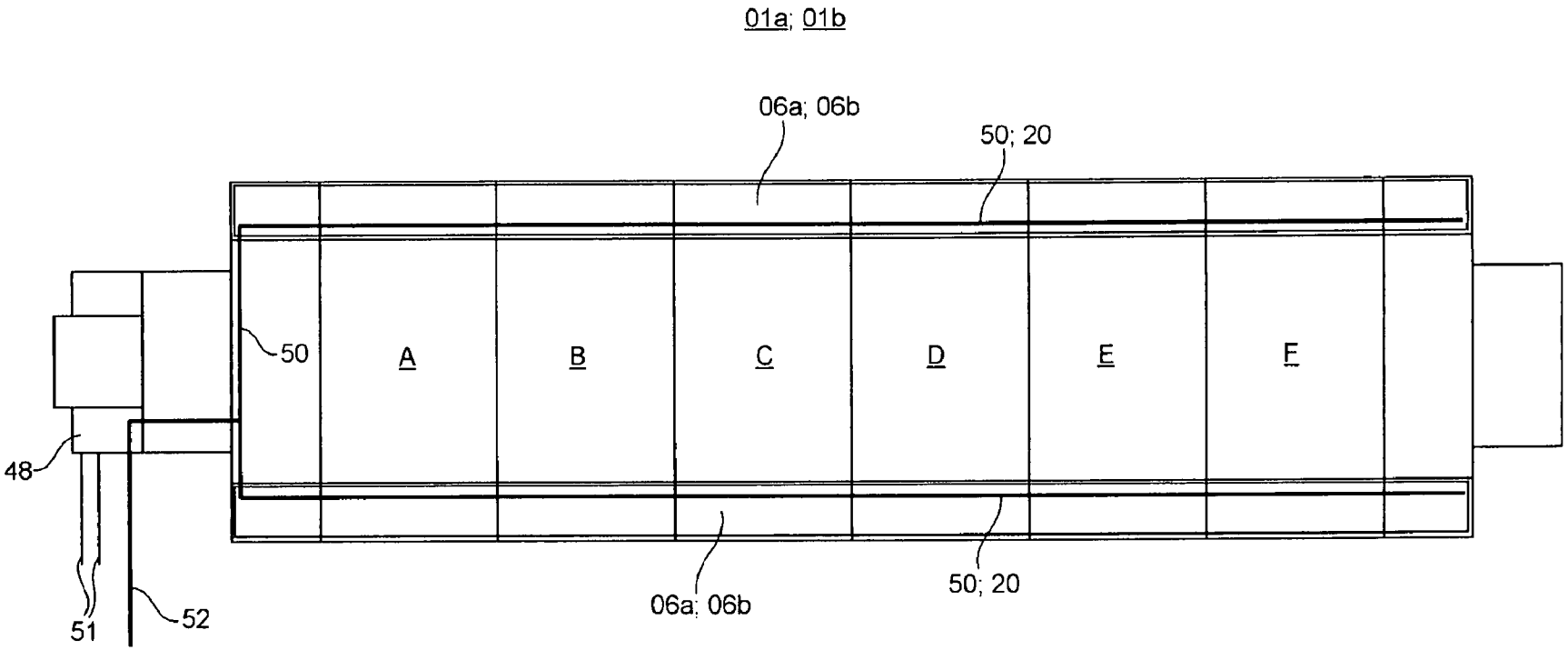
FIG. 6 a schematic, sectional representation of the cylinder depicted in FIG. 3 through FIG. 5.

FIG. 6 shows one of the cylinders 01*a*; 01*b*, which was represented in FIG. 3, in a simplified longitudinal section. This cylinder 01*a*; 01*b* has six sections A; B; C; D; E; F, for example, which are positioned side by side in the axial direction of cylinder. These sections A; B; C; D; E; F all correspond to individual mounting sites, in each of which mounting sites a packing 03*a*; 03*b* can be positioned. The cylinder 01*a*; 01*b* has two channels 06*a*; 06*b* on its periphery, with each extending continuously along this cylinder 01*a*; 01*b* in its axial direction, and being offset 180° from one another. One of the embodiments of the two retaining devices, not specifically shown, and specified in connection with FIG. 1 or FIG. 2, are arranged in these channels 06*a*; 06*b*. Thus, in preferably each of the channels 06*a*; 06*b*, base elements 41 are provided next to one another in a row and are assigned to the respective sections A; B; C; D; E; F. These base elements 41 each hold a packing 03*a*; 03*b*, which is positioned in the relevant section A; B; C; D; E; F on the outer surface 02 of the relevant cylinder 01*a*; 01*b*, by a force that is exerted at least on its trailing end 12; 33.

Figure 7:
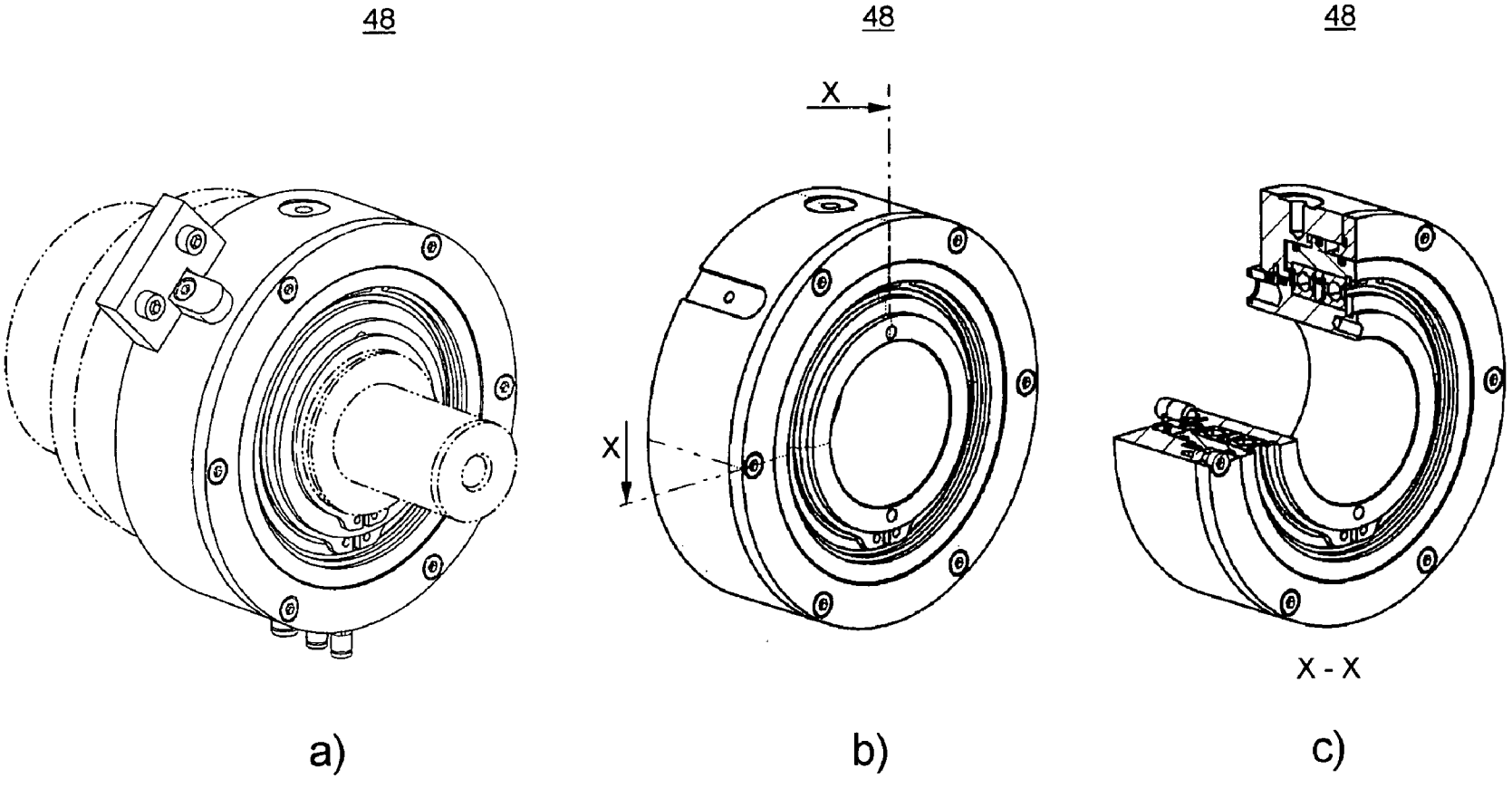
FIG. 7 three perspective representations a), b) and c) of a compressed air supply device.
Figure 8:
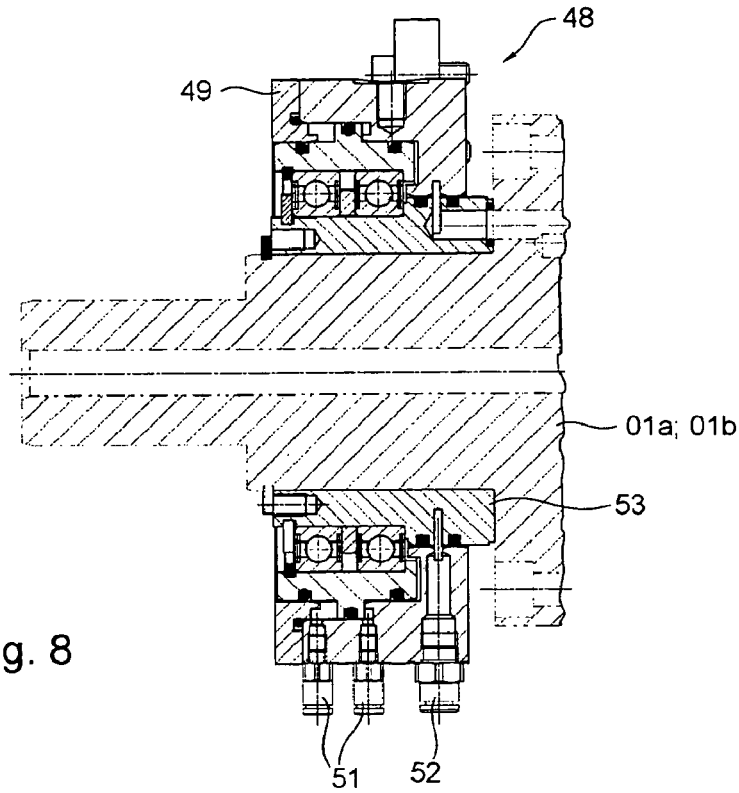
FIG. 8 a longitudinal cross-section of the compressed air supply device of FIG. 7, shown in a first operating position.
Figure 9:
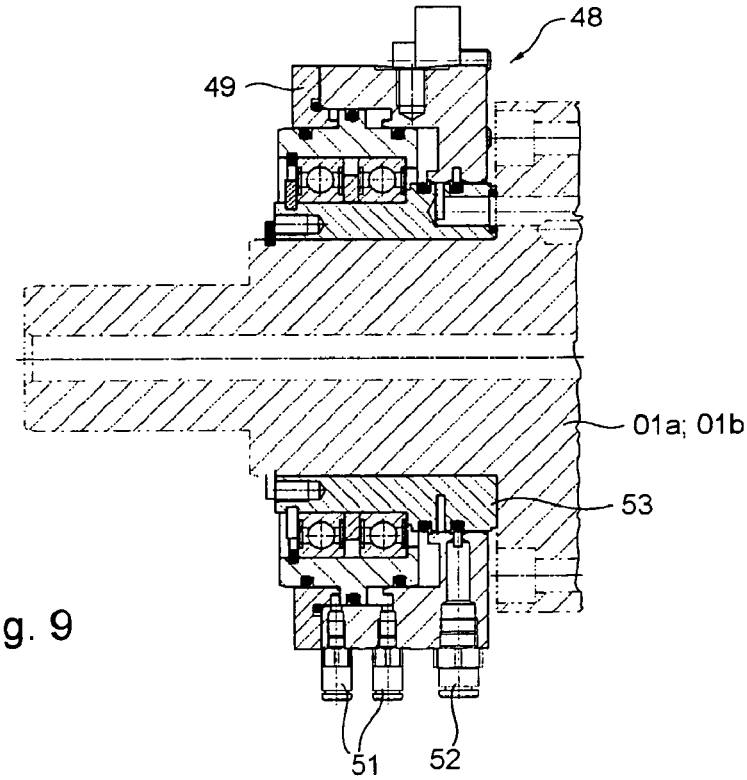
FIG. 9 a longitudinal cross-section of the compressed air supply device of FIG. 7, shown in a second operating position.

As was specified in connection with FIG. 1 or FIG. 2, at least one preferably pneumatic control device 20, when actuated, counteracts the force that is exerted by the at least one spring element 17; 37 via the retaining assembly 16 or the clamping device 36 on the clamping position 25; 45. The result is that the clamping force which is applied at each respective retaining assembly 16 or clamping device 36 is released by actuating the respective control device 20. To actuate the respective control device 20, the cylinder 01*a*; 01*b* is supplied with a fluid under pressure, such as compressed air, by the provision means of a compressed air supply device 48 that is attached to an end surface 46 of the relevant cylinder 01*a*; 01*b*. This compressed air supply device 48, which is preferably embodied as a rotating intake, is shown in FIG. 7 in a first partial drawing a) in its status attached to the cylinder 01*a*; 01*b*, in a second partial drawing b) as a separate component, and in a third partial drawing c) in combination with a partial, sectional representation X-X. FIG. 8 and FIG. 9 each show a longitudinal section through this compressed air supply device 48 shown in FIG. 7. This compressed air supply device 48, as may be seen in FIGS. 8 and 9, has a non-rotatable, annular outer part 49, on which ports 51; 52, and in particular, pneumatic ports 51; 52, are formed for supplying compressed air. An inner part 53 of the compressed air supply device 48 is connected to an axle journal of the cylinder 01*a*; 01*b* and is capable of rotating together with the relevant cylinder 01*a*; 01*b*. This type of compressed air supply device 48 is thus also called a rotating intake. A portion of the non-rotating outer part 49 of the compressed air supply device 48, which may be, for example, mounted on a roller bearing, is axially displaceable in relation to its inner part 53. The axially displaceable outer part 49 thus has at least two stable, adjustable operating positions. In a first such operating position, compressed air is supplied from the outside and is transferred to the inner part 53 and is then introduced into the relevant cylinder 01*a*; 01*b*. In a second such operating position, the supply of compressed air to the relevant cylinder 01*a*; 01*b* is blocked, because compressed air that has been supplied from the outside cannot be transferred to the inner part 53. Preferably, only a single compressed air supply device 48 is provided on the relevant cylinder 01*a*; 01*b*, and is situated at only one of its end surfaces 46.

Figure 10:
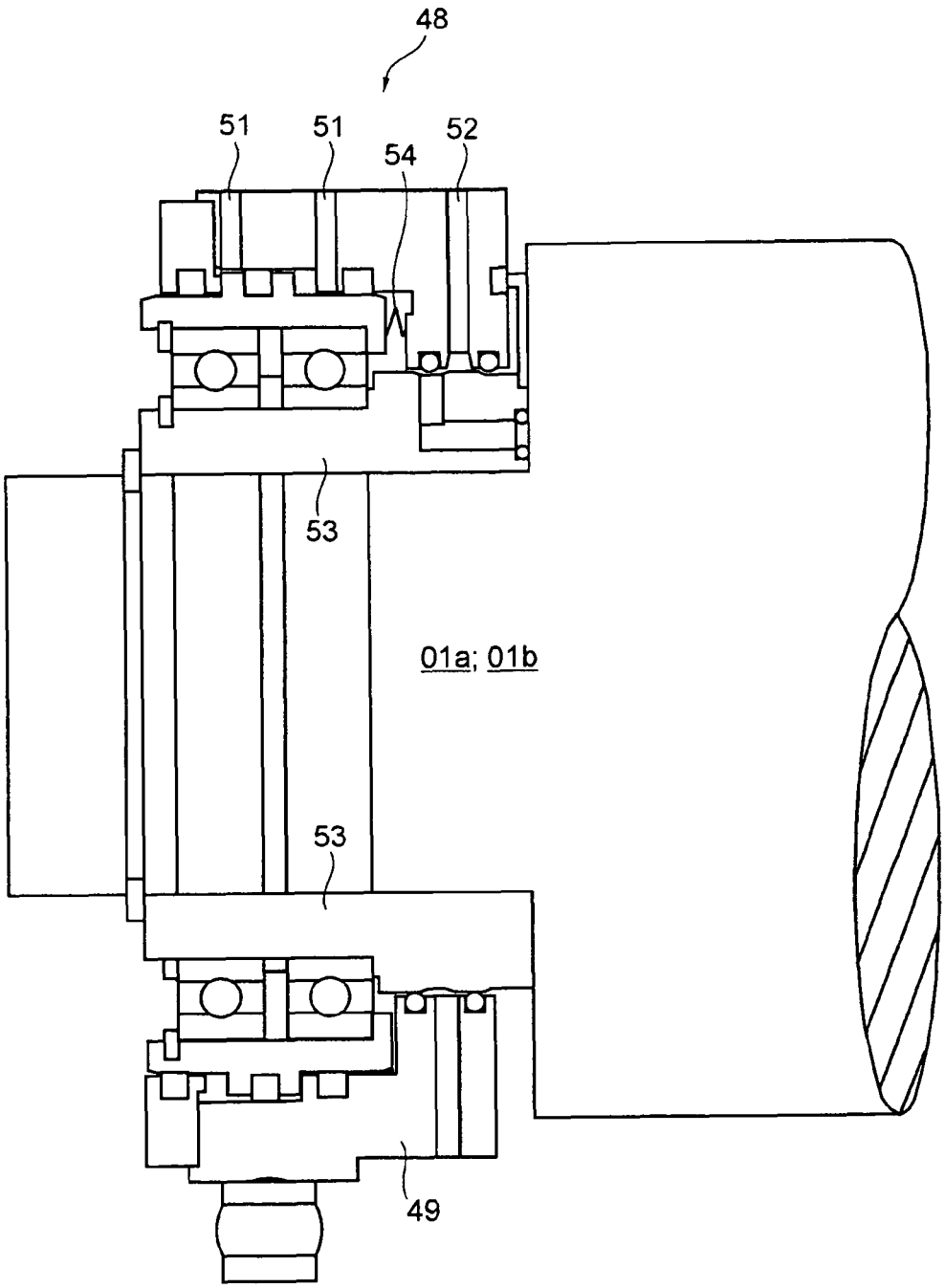
FIG. 10 a further schematic representation of the compressed air supply device of FIG. 7, shown as a longitudinal section.

FIG. 10 also shows the compressed air supply device 48, in a schematic representation of a longitudinal section. The pneumatic port 52, which is located closer to an end surface of the relevant cylinder 01*a*; 01*b*, and which is represented enlarged in FIG. 8 through FIG. 10 by way of example, serves to supply compressed air which is to be introduced into the channels 06*a*; 06*b* and which is usable for actuating the control devices 20 that are located in those channels 06*a*; 06*b*. The two smaller pneumatic ports 51, which are visible particularly in FIG. 8 through FIG. 10, serve to actuate the outer part 49 of the compressed air supply device 48, which is axially displaceable, in relation to the inner part 53, to provide the choice of the two respective operating positions. The compressed air supply device 48 is preferably remotely actuable. In FIG. 10, a spring element 54, which is acting in the axial direction of the relevant cylinder 01*a*; 01*b*, is shown as a component of the compressed air supply device 48. This spring element 54 uses a spring force to displace the outer part 49 back to its initial position, when its operating position is changed in relation to the inner part 53. It is advantageous that the compressed air, which is to be distributed to the respective retaining devices on the relevant cylinder 01*a*; 01*b*, is transferred via only a single line 52 from an outer compressed medium source to the rotating or at least to the rotatable cylinder 01*a*; 01*b*. The compressed air, which is to be distributed over the relevant cylinder 01*a*; 01*b* to control assemblies 20 which may be arranged in two different channels 06*a*; 06*b*, for example, is preferably introduced radially into the outer part 49 of the compressed air supply device 48. This compressed air is then passed on from the inner part 53 of the compressed air supply device 48 coaxially to the relevant cylinder 01*a*; 01*b*. It is introduced in an end surface 46 of the relevant cylinder 01*a*; 01*b*, as seen in FIG. 6 through FIG. 10. The so introduced compressed air is then distributed from this single port 52 through corresponding lines 50 and, for example, through at least one device, which is situated in a recess in the relevant cylinder 01*a*; 01*b* and which is intended for distributing the compressed air, which device is preferably located near the end surface, and in particular, is located outside of the sections A; B; C; D; E; F, and thus is located outside of the printing area of the outer surface 02 of the relevant cylinder 01*a*; 01*b* shown in FIG. 6. In a preferred embodiment of the present invention, at least the part of the lines 50, which are extending in the axial direction of the relevant cylinder 01*a*; 01*b*, can be identical to the hose 20, which is used in the relevant channel 06*a*; 06*b* as a control device 20. In this case, the control device 20, which is embodied as a hose 20, when actuated, can act simultaneously on all of the retaining devices arranged in the relevant channel 06*a*; 06*b*, and can effect a release of the packings 03*a*; 03*b* arranged there in all of the sections A; B; C; D; E; F of the relevant cylinder 01*a*; 01*b*, arranged side by side.

In accordance with the present invention, it is now provided that in at least one discrete, stable operating position of the retaining device, which operating position is different from both the "open" and "closed" operating positions, the force that is exerted by the retaining device on the at least one end 12; 33 of the packing 03*a*; 03*b* is adjusted or is set to a value that is different from its minimum value or its maximum value. This additional operating position of the retaining device is achieved, in the preferred embodiment, by the attainment of a specific operating position of the control device 20. The clamping action of the retaining devices, as is apparent, when viewed in connection with FIG. 1 and with FIG. 2, is greatest when the control device or devices 20 is or are unactuated. In addition to this operating position of the retaining device with maximum clamping action, which may be referred to as a "closed" operating position, and the operating position of the retaining device in which the clamping action of the retaining devices is fully released and thus a minimum clamping effect, namely reduced to zero, exists, and which may be referred to as an "open" operating position, at least one additional discrete, stable operating position for the retaining device is now provided. In this third or additional discrete stable operating position for the retaining device, the clamping action assumes an intermediate value, which is between its minimum value and its maximum value. A favorable intermediate value for the clamping action, in this third stable operating position for the retaining device, is between 3% and 40% of its maximum value, for example, and preferably is between 5% and 20% of its maximum value. The additional operating position of the retaining device is discrete and stable to the extent that it can be reproducibly adjusted by the use of structural and/or control-engineering measures. The retaining device retains its adjustment in this third stable operating position until a different operating position of the retaining device is set. This additional operating position for the retaining device is thus embodied as being self-holding, for example.

The additional, intermediate operating position for the retaining device, which is being added to the aforementioned extreme positions and which may be referred to as a "securing" operating position, can be implemented through various individual or combined measures. One such measure, which is based more upon control engineering, can consist in providing the pressure, in particular in providing the pressure of the compressed air, which is acting in the lines 50 and thus in or on the control devices 20, to be variable or at least adjustable in discrete stages, with this adjustment being implemented via a control device, which is not specifically shown here. For this purpose, compressed air can be fed into the cylinder 01*a*; 01*b*, for example, at different compressed air levels, via the pneumatic port 52, or a regulating device, such as a valve, may be provided in, or on the cylinder 01*a*; 01*b*, and with which regulating device the compressed air acting in the lines 50 and thus in or on the control means 20 can be adjusted, preferably via remote actuation.

Figure 11:
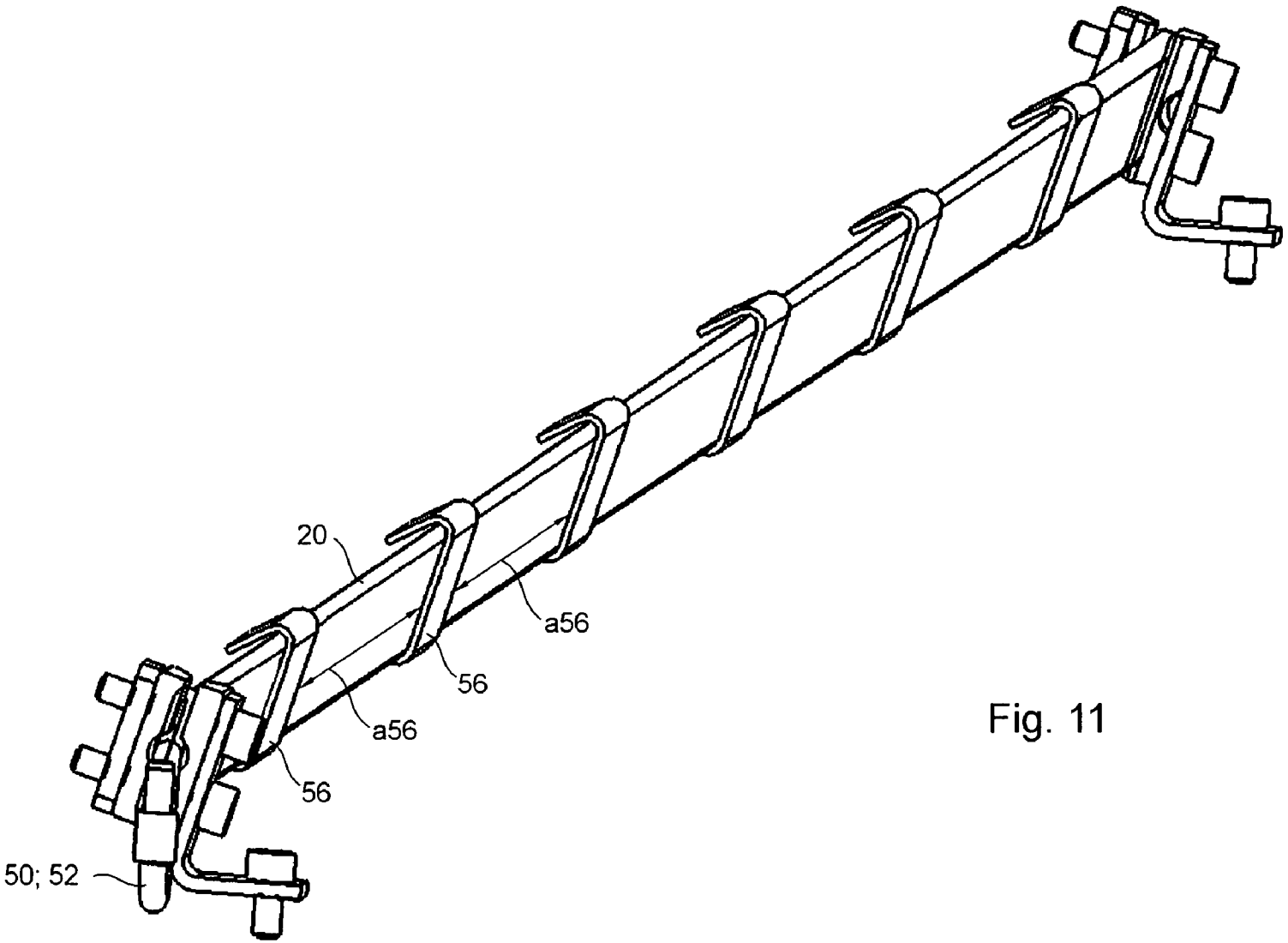
FIG. 11 a perspective representation of a control assembly with a limited control path.
Figure 12:
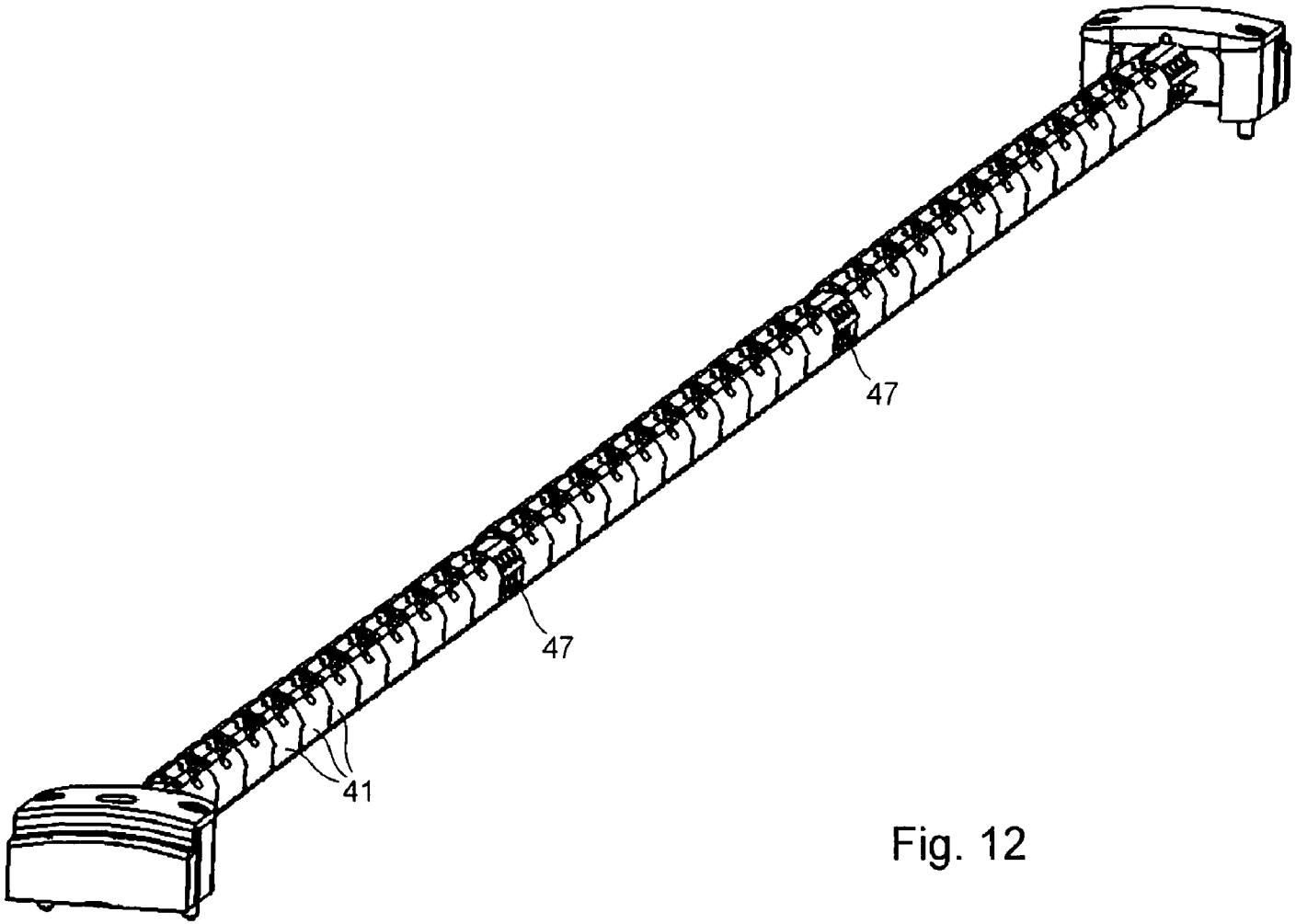
FIG. 12 a perspective component representation of base elements arranged in a row.

Another, more structural measure, can provide that with a partial number of such retaining devices each exerting a force on at least one end 12; 33 of the respective packing 03*a*; 03*b* in each one of the sections A; B; C; D; E; F, the respective forces of these relevant retaining devices cannot be fully released. Preferably, the action of the at least one control device 20, with respect to the retaining devices arranged in a row in the relevant channel 06*a*; 06*b*, and which are each active for a specific one of the sections A; B; C; D; E; F, is segmented. This can be implemented, for example, in that the at least one control device 20 acts on only a partial number of the retaining devices, which are arranged in the relevant channel 06*a*; 06*b*, and which are each assigned to one of the sections A; B; C; D; E; F. Alternatively, or additionally, it can be provided that, at least with respect to a partial number of the retaining devices that are arranged in the relevant channel 06*a*; 06*b*, and which are each assigned to one of the sections A; B; C; D; E; F, an adjustment path of the control device 20 that is assigned to at least one of these retaining devices is limited. Not all the retaining devices, which are arranged in the relevant section A; B; C; D; E; F, abandon their respective clamping action fully. Instead, they reduce their respective clamping force to only an intermediate level, which is between their minimum value and their maximal value. Such a limitation of the adjustment path of the relevant control device 20 can be achieved, for example, by preferably providing at least one stop in the relevant channel 06*a*; 06*b*, which stop limits the adjustment path. In one advantageous embodiment of the present invention, a stop that limits the adjustment path can be implemented by encompassing the flexible hose 20, at least in sections, by a preferably rigid collar 56, and in particular, at least partially encompassing it. The collar 56, which may be seen in FIG. 11, allows compressed air to pass through the hose 20, but limits the radial extension of the radially extending hose 20 when it is pressurized with compressed air. In FIG. 11, a hose 20 that can be positioned in a channel 06*a*; 06*b*, and which is provided with multiple collars 56, in this case a total of six such collars 56, any which collars 56 are attached along its lengthwise extension, is shown as an independent component. Distances a56 between adjacent collars 56, each such collar 56 being formed by a plate bracket, for example, are preferably equal in size. Compressed air is supplied to this hose 20 via the line 50 or the pneumatic port 52. When the hose is pressurized with compressed air, it widens and thus bulges in the areas between the collars 56, or at its beginning and at its end, thereby pivoting the respective retaining assembly 16 or the clamping element 36, which are not specifically shown in FIG. 11, against the force of the at least one spring element 17; 37, and away from the respective clamping position 25; 45, as seen in FIG. 1 and in FIG. 2. A hose 20 of this type, with such a segmented action, can extend through base elements 41 that are arranged next to one another in a row in a channel 06*a*; 06*b* and, if applicable, can also extend through the at least one spacer element 47 located between groups of base elements 41, as illustrated by the representation of components in FIG. 12 and as seen, in particular, in combination with FIG. 5.

Thus, a cylinder 01*a*; 01*b* of a printing press, and having at least one channel 06*a*; 06*b* extending in the axial direction below its outer surface 02, is formed. A retaining device, that is located in the channel 06*a*; 06*b*, exerts a force on at least one end 12; 33 of a packing 03*a*; 03*b* which is positioned or is to be positioned on the outer surface 02 of the cylinder 01*a*; 01*b*. At least one control device 20 is provided. This at least one control device 20, in its actuated, operating position, counteracts the force that is exerted, by the retaining device, on the at least one end 12; 33 of the packing 03*a*; 03*b* which is positioned or which is to be positioned on the outer surface 02 of the cylinder 01*a*; 01*b*. The force that is exerted by the control device 20 can be adjusted to an intermediate value that is different from its minimum value or maximum value. The outer surface 02 of this cylinder 01*a*; 01*b* is subdivided, in its axial direction, into multiple sections A; B; C; D; E; F which are arranged side by side. In at least one of these sections A; B; C; D; E; F, multiple retaining devices are arranged side by side in the channel 06*a*; 06*b*. The respective forces exerted by the at least one control device 20 on at least two different retaining devices which are positioned in the same section A; B; C; D; E; F are different from one another in terms of their respective value.

As was previously set forth in connection with FIG. 1 and with FIG. 2, multiple spring elements 17; 37 can also be assigned to one retaining assembly 16 or clamping piece 36. The clamping force can also be adjusted to an intermediate value between its minimum value and its maximum value by assigning fewer spring elements 17; 37 or by using spring elements 17; 37 that have a lower spring force, for example, to a specific retaining means 16 or to a specific clamping element 36, or to a partial number of the aforementioned retaining assemblies 16 or clamping elements 36, as compared with other retaining assemblies 16 or clamping elements 36 which may be arranged in the same channel 06*a*; 06*b*. In other words, for different retaining devices, which are arranged in the same channel 06*a*; 06*b*, and each with at least one of the assigned retaining assemblies 16 or clamping elements 36, or with a partial number of these retaining assemblies 16 or clamping elements 36, either a smaller number of spring elements 17; 37 than with the other retaining devices is used, especially if spring elements 17; 37 having the same or at least comparable spring force are used, or, if the same number of spring elements 17; 37 are used, these have a different, and in particular, have a lower, spring force. When the control device 20, which is located in the relevant channel 06*a*; 06*b*, is then actuated, for example by accomplishing its pressurization with compressed air, and at a specific adjusted, value for the level of such compressed air, the clamping effect of the retaining assemblies 16 or of the clamping elements 36, which are arranged in the relevant channel 06*a*; 06*b* is not completely released, but is only incompletely released, due to the different spring forces.

All the various measures, which have been discussed above, by way of example, result in an adjustment of the force which is exerted by the retaining device on the at least one end 12; 33 of the packing 03*a*; 03*b* to a value that is different from its minimum value or maximum value, when the respective retaining device is in at least one operating position that is different from the "open" and "closed" operating positions. The position of a packing or dressing or printing blanket 03*a*; 03*b*, which is held by at least one of its ends 12; 33 in the relevant channel 06*a*; 06*b*, and which is positioned on the outer surface 02 of the relevant cylinder 01*a*; 01*b*, can be adjusted, but is still adequately secured in place on the relevant cylinder 01*a*; 01*b*. If such a packing 03*a*; 03*b* is to be removed completely from the outer surface 02 of the relevant cylinder 01*a*; 01*b*, this removal can be accomplished with the support, for example, of compressed air that may be pumped in laterally or from the rear under this packing 03*a*; 03*b*, or by the utilization of some other force that raises the packing 03*a*; 03*b* from the outer surface 02 of the relevant cylinder 01*a*; 01*b*. Just as when the retaining device is in the operating position referred to as "securing", at least one packing 03*a*; 03*b* can be released from the outer surface 02 of the relevant cylinder 01*a*; 01*b*, when the retaining device is in this operating position referred to as "securing", at least one end 12; 33 of the relevant packing 03*a*; 03*b* can be inserted into the relevant channel 06*a*; 06*b*.

FIG. 13 shows, in a perspective depiction, one of the flexible packings or dressings or printing blankets 03*a*; 03*b* that can be arranged on the outer surface 02 of one of the cylinders 01*a*; 01*b*, in its longitudinal extension l. The previously discussed bent legs 04; 05; 34; 35 are attached to each of the packing's respective, opposite ends 11; 12; 32; 33, as was discussed in connection with FIG. 1 and with FIG. 2. The packing 03*a*; 03*b* has a width b, which width b is oriented axially along the relevant cylinder 01*a*; 01*b* when the packing is mounted on the outer surface 02 of the respective cylinder 01*a*; 01*b*.

Figure 14:
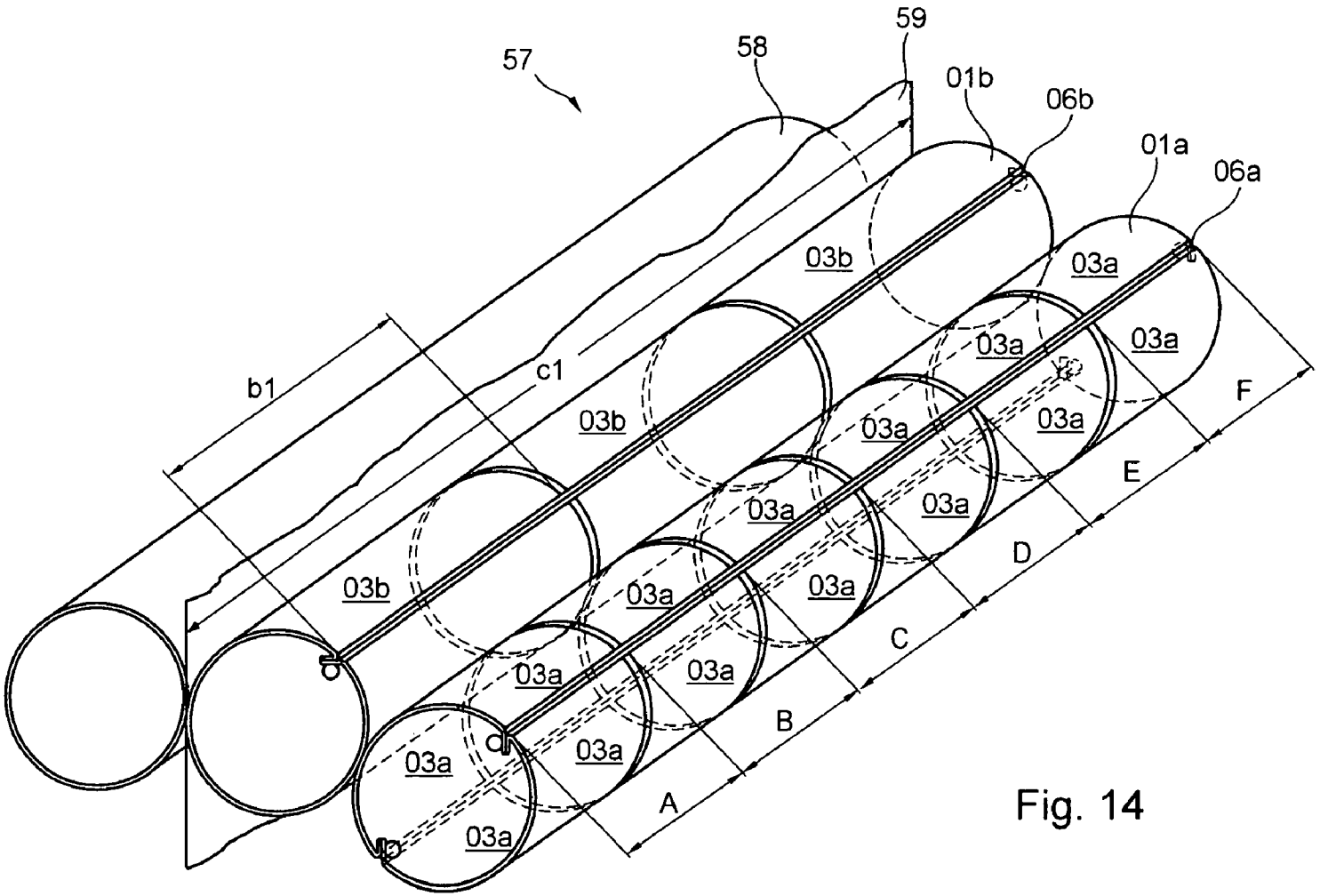
FIG. 14 a printing couple with cooperating cylinders in accordance with the present invention, in a first operating mode.
Figure 15:
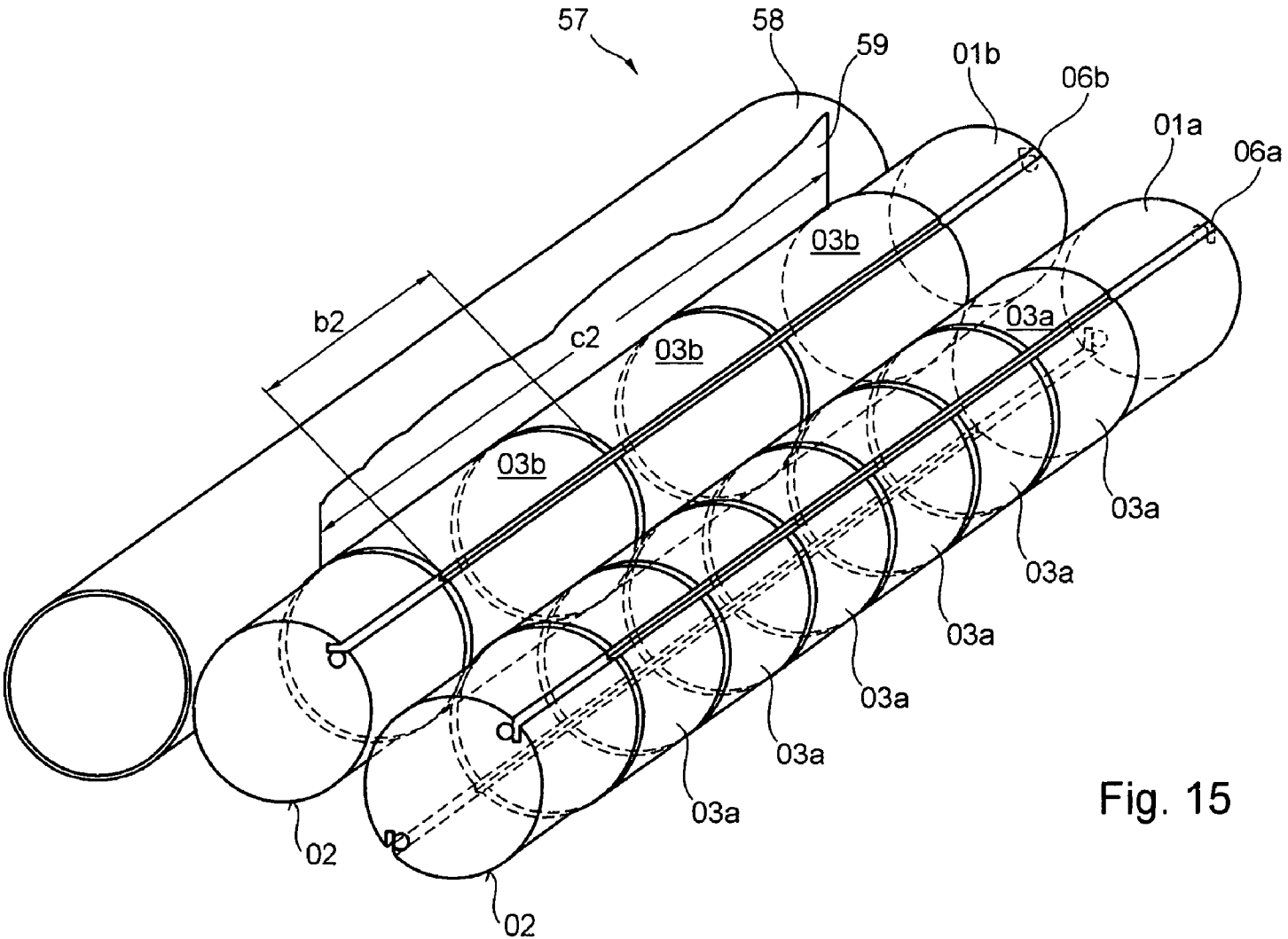
FIG. 15 the printing couple of FIG. 14 with cooperating cylinders in a second operating mode.
Figure 16:
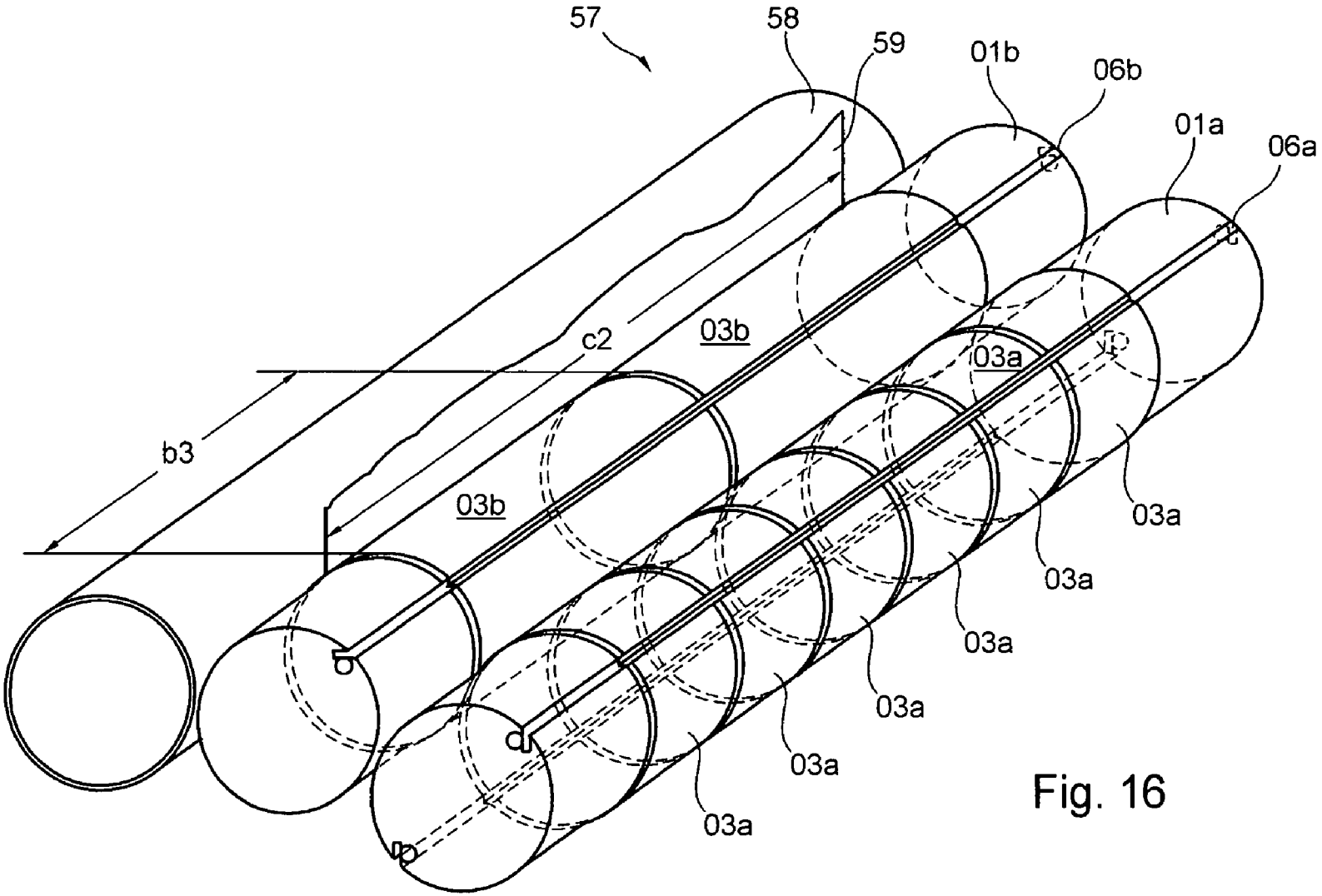
FIG. 16 the printing couple of FIG. 14 with cooperating cylinders in a third operating mode.

FIG. 14 through FIG. 16 each show a simplified representation of a printing couple 57, in which a forme cylinder 01*a* and a transfer cylinder 01*b* of the above-described type cooperate. The transfer cylinder 01*b* rolls off against a cylinder 58, such as, for example, are impression cylinder 58. A material web 59 is fed through a printing gap defined between the transfer cylinder 01*b* and the impression cylinder 58. The impression cylinder 58 can also be embodied as another transfer cylinder 01*b*. The forme cylinder 01*a* is subdivided axially into multiple sections, in this case six such sections, A; B; C; D; E; F. In each of these sections, A; B; C; b; E; F, two printing formes 03*a* are arranged one after the other in the circumferential direction of this cylinder 01*a*. The transfer cylinder 01*b* has three packings 03*b*, for example, three so-called metal printing blankets 30, each extending around the circumference of this cylinder 01*a*, and arranged side by side on its outer surface 02, for example. These packings 03*b* each have a first width b1 in the axial direction of the transfer cylinder 01*b*, with this first width b1 corresponding to the width of two adjoining sections A; B; C; D; E; F of the forme cylinder 01*a*. At least one channel 06*a*; 06*b*, in which the respective ends of the relevant packings 03*a*; 03*b* are held, extends axially through each forme cylinder 01*a* and through each transfer cylinder 01*b*. A first width c1 of the material web 59 which is being fed between the transfer cylinder 01*b* and the impression cylinder 58 corresponds, at least approximately, to the axial length of the cylinders 01*a*; 01*b*; 58 cooperating in this printing couple 57.

FIG. 15 shows the same printing couple 57 as is depicted in FIG. 14. In this case, a material web 59, having a second width c2, is fed through the printing gap between the transfer cylinder 01*b* and the impression cylinder 58. Correspondingly, packings or printing blankets 03*b* of a second width b2, which is different from the first width b1, are then mounted on the transfer cylinder 01*b*. An adjustment of the mounting position, and of the widths of the respective packings 03*a* has also been made on the forme cylinder 01*a*.

As an alternative to the operating mode of the cylinders 01*a*; 01*b* shown in FIG. 15, and when a material web 59 of the second width c2 that is different from the first width c1 is used, at least the transfer cylinder 01*b* could also be covered with a second number of packings or printing blankets 03*b*, which number is different from the first number of packings 03*b* shown in FIGS. 14 and 15. With this second number of packings 03*b*, each of these packings 03*b* preferably has a third width b3, which is different, at least, from its second width b2, and which represents a further operating mode for the cylinders 01*a*; 01*b* in this printing couple 57. In yet another operating mode for the cylinders 01*a*; 01*b*, for an adjustment to the respective width c1; c2 of the material web 59 to be printed in this printing couple 57, packings 03*a*; 03*b* of different widths b1; b2; b3 are also arranged on the outer surface 02 of the same cylinder 01*a*; 01*b*. It can thus be provided that the outer surface 02 of the respective cylinder 01*a*; 01*b* has a first number of packings 03*a*; 03*b* in a first operating mode, at least one of which has a first width b1 measured in the axial direction of the cylinder 01*a*; 01*b*. In a second operating mode, this cylinder 01*a*; 01*b* has at least one packing 03*a*; 03*b* with a width b2; b3 that is different from the first width b1, and/or that in a second operating mode, this cylinder 01*a*; 01*b* has a second number of packings 03*a*; 03*b*, which differs from the first number of packings 03*a*; 03*b*.

The above-described, freely selectable operating mode of the respective cylinder 01*a*; 01*b*, particularly with respect to its covering with different numbers of packings 03*a*; 03*b* and/or with packings 03*a*; 03*b* of different widths b1; b2; b3, is enabled in combination with at least one channel 06*a*; 06*b*, and preferably extending continuously through the respective cylinder 01*a*; 01*b*, and based upon the use of retaining devices that are arranged in the relevant channel 06*a*; 06*b*. In at least one discrete, stable operating position of such retaining devices, which stable operating position is different from the stable operating positions "open" and "closed," the force, which is exerted on the at least one end 12; 33 of the respective packing 03*a*; 03*b*, is adjusted to a value that is different from its minimum value or maximum value, for example, by actuating at least one control device 20.

While preferred embodiments of a cylinder of a printing press, with at least one channel extending in the axial direction, below the outer surface of the cylinder, in accordance with the present invention, have been described fully and completely hereinabove, it will be apparent to one of skill in the art that various changes in, for example, the specific structures of the printing units in which the subject cylinders are used, the source of supply of the compressed air and the like could be made without departing from the true spirit and scope of the present invention which is accordingly to be limited only by the appended claims.

What is claimed is:

1. A cylinder of a printing press comprising:

A cylinder outer surface, said cylinder outer surface being subdivided axially into multiple sections arranged side by side;

a channel extending in said cylinder, in its axial direction, and below said cylinder surface;

at least one retaining device located in said channel to exert a retaining force on at least one end of a packing positioned or to be positioned on said outer surface of said cylinder;

at least one control means in said channel, said at least one control means, in its actuated operating state, exerting a counteracting force opposing said retaining force exerted by said at least one retaining device on said at least one end of said packing positioned or to be positioned on said outer surface of said cylinder;

means for adjusting a counteracting said force exerted by said at least one control means to a counteracting force value that is different from its minimum value or its maximum value;

a plurality of said retaining devices arranged side by side in said channel in at least a specific one of said multiple sections;

means segmenting an action of said at least one control means with respect to said plurality of said retaining devices arranged side by side in said at least a specific one of said multiple sections and which are active for said at least a specific one of said multiple sections, such that one of, when said control means is actuated, it acts on only a partial number of said plurality of said retaining devices arranged side by side in said channel and assigned to said at least a specific one of said multiple sections and/or such that, at least with respect to a partial number of said plurality of said retaining devices arranged side by side in said channel and assigned to said at least a specific one of said multiple sections, an adjustment path of said control means assigned to said at least a specific one of said plurality of said retaining devices arranged side by side in said channel and assigned to said at least one specific one of said multiple sections is limited by at least one stop for limiting said adjustment path wherein, the respective forces exerted by the at least one control means on at least two different ones of said retaining devices arranged in said at least a specific one of said multiple sections are different from one another in terms of their respective value.

2. The cylinder of claim 1 wherein said channel extends continuously through said entire cylinder.

3. The cylinder of claim 1 wherein each of said multiple sections correspond with mounting sites, in each of which mounting sites a packing can be positioned.

4. The cylinder of claim 1 wherein said control means is acted upon by a pressure medium.

5. The cylinder of claim 4 wherein said pressure medium acting and on said control means is one of variable and adjustable in discrete steps.

6. The cylinder of claim 1 wherein said control means, when actuated, acts on only one of said multiple sections.

7. The cylinder of claim 1 wherein said control means, when actuated, acts in multiple sections simultaneously.

8. The cylinder of claim 1 wherein said control means, when actuated, extends radially outward and further wherein a its radial extension is limited.

9. The cylinder of claim 1 wherein said retaining force exerted by said at least one retaining device on said at least one end of said packing is adjusted by said at least one control means to a value of between 3% and 40% of a maximum retaining force value.

10. The cylinder of claim 9 wherein said value is between 5% and 20% of said maximum retaining force value.

11. The cylinder of claim 1 wherein for at least one' or for said partial number of said plurality of said retaining devices arranged in said channel in said at least a specific one of said multiple sections, said retaining force exerted by said at least one retaining device on said at least one end of said packing positioned or to be positioned on said outer surface of said cylinder cannot be fully removed by actuating said control means.

12. The cylinder of claim 1 wherein said control means, when actuated, adjusts said at least one retaining device to an additional operating position different from its open operating position and its closed operating position.

13. The cylinder of claim 1 wherein, in a first operating mode, said cylinder outer surface has a first number of said packings at least one of which has a first packing width measured in said cylinder axial direction and wherein in a second operating mode, said cylinder outer surface has one of at least one packing which has a second packing width, different from said first packing width, and/or that in a second operating mode, said cylinder outer surface has a second number of packings that is different from said first number of packings.

14. The cylinder of claim 1 wherein said cylinder is one of a forme cylinder and a transfer cylinder.

15. The cylinder of claim 1 wherein multiple ones of said packings, each embodied as one of a printing forme and a printing blanket, are arranged on said cylinder outer surface.

* * * * *

UNITED STATES PATENT AND TRADEMARK OFFICE

CERTIFICATE OF CORRECTION

PATENT NO. : 7,861,654 B2
APPLICATION NO. : 12/734847
DATED : January 4, 2011
INVENTOR(S) : Koblinger It is certified that error appears in the above-identified patent and that said Letters Patent is hereby corrected as shown below:

IN THE CLAIMS:

Column 19, in claim 1, line 20, after “adjusting”, cancel “a” and insert -- said --, and after “counteracting”, delete “said”.

Signed and Sealed this
Seventeenth Day of May, 2011

David J. Kappos

David J. Kappos
*Director of the United States Patent and Trademark Office*